US010040103B2

(12) United States Patent
Belik

(10) Patent No.: US 10,040,103 B2
(45) Date of Patent: Aug. 7, 2018

(54) THREAD CLEANING DEVICE

(71) Applicant: NATIONAL OILWELL VARCO, L.P., Houston, TX (US)

(72) Inventor: Jaroslav Belik, Smithville, TX (US)

(73) Assignee: National Oilwell Varco, L.P., Houston, TX (US)

( * ) Notice: Subject to any disclaimer, the term of this patent is extended or adjusted under 35 U.S.C. 154(b) by 694 days.

(21) Appl. No.: 14/473,949

(22) Filed: Aug. 29, 2014

(65) Prior Publication Data

US 2016/0059279 A1 Mar. 3, 2016

(51) Int. Cl.

*B08B 9/032* (2006.01)
*B08B 9/02* (2006.01)
*E21B 12/06* (2006.01)

(52) U.S. Cl.

CPC ..... *B08B 9/021* (2013.01); *E21B 12/06* (2013.01)

(58) Field of Classification Search

CPC ..... E21B 12/06; B08B 9/021
See application file for complete search history.

(56) References Cited

U.S. PATENT DOCUMENTS 3,436,783 A * 4/1969 McCartney ..... B08B 9/021 134/6
3,971,442 A * 7/1976 Scott ..... E21B 19/20 15/104.04
4,011,617 A * 3/1977 Toelke ..... E21B 17/006 134/168 C
4,014,062 A * 3/1977 Scott ..... B08B 9/021 15/104.04
4,157,096 A * 6/1979 Miller, Jr. ..... B08B 9/021 134/111
4,372,003 A * 2/1983 Toelke ..... B08B 9/021 15/104.04
4,403,363 A * 9/1983 Hess ..... B08B 9/021 15/104.04
4,433,448 A * 2/1984 True ..... B08B 9/021 15/104.04
4,593,451 A * 6/1986 Roberts ..... B08B 9/021 15/104.04
5,157,802 A * 10/1992 Guidry ..... E21B 17/006 15/104.04
5,317,780 A * 6/1994 Hobgood ..... E21B 17/006 15/104.04
5,372,154 A * 12/1994 Bee ..... B08B 9/021 134/110
5,857,476 A * 1/1999 Bee ..... B08B 9/021 134/167 C
7,263,737 B1 * 9/2007 Walsh ..... B08B 9/021 15/104.04
2004/0049905 A1 * 3/2004 Jansch ..... E21B 19/164 29/428
2013/0340794 A1 * 12/2013 Flynn ..... B08B 9/0328 134/22.12

* cited by examiner

*Primary Examiner* — Michael Barr
*Assistant Examiner* — Benjamin L Osterhout
(74) *Attorney, Agent, or Firm* — Conley Rose, P.C.

(57) ABSTRACT

An apparatus for servicing tubular members includes a cleaning fluid delivery system, a motor configured to provide rotational movement to the cleaning fluid delivery system, and a cleaning fluid actuator configured to provide pressurized cleaning fluid to the cleaning fluid delivery system.

28 Claims, 13 Drawing Sheets

THREAD CLEANING DEVICE

CROSS-REFERENCE TO RELATED APPLICATION

Not applicable.

STATEMENT REGARDING FEDERALLY SPONSORED RESEARCH OR DEVELOPMENT

Not applicable.

BACKGROUND

The present disclosure relates generally to the servicing of tubular members. More particularly, the present disclosure relates to methods and apparatus for cleaning the threads of tubular members.

At some point during the drilling of a well, there will be a reason to pull a drill string out of a well and then run it back in. This process is typically referred to as "tripping." The portion of the tripping involving pulling the drill string out of the well may be referred to as "tripping out," and the portion of the tripping involving running the drill string back into the well may be referred to as "tripping in." Tripping out involves breaking out pipe connections, whereas tripping in involves making up pipe connections, or in other words, connecting the drill pipe to the drill string. On some rigs, the breaking out and making up of pipe connections are between single drill pipes, as opposed to pipe stands, and a drill string. Single drill pipes or pipe joints often include a "pin" or pin end and a "box" or box end, where the pin end is configured to threadably inserted into and coupled with the box end of an adjacent pipe joint in order to make up a pipe connection.

In some cases, prior to connecting a drill pipe to the drill string, the pin and box of the drill pipe are cleaned. Typically, this cleaning is carried out while the drill pipe is in the vertical position. The cleaning of the drill pipe and the lubrication of the box prior to making up the pipe connection lengthen the duration of the tripping in. Also, the vertical orientation of the drill pipe during the cleaning, as well as time constraints on rig operations can make it difficult to achieve quality pipe cleaning and lubrication. Further, the apparatuses and methods used to clean the drill pipe are restricted to either rig or a pipe inspection plant. For instance, in some cases the pin and box ends of the drill pipe may be cleaned and lubricated at a pipe inspection plant prior to transportation to the drilling rig for installation. In other cases, the drill pipe joints may be prepared (i.e., pin and box ends cleaned and lubricated) at a machine shop prior to installation at the drilling rig.

Accordingly, there remains a need in the art for apparatuses and methods directed towards preparing the pin and box ends of drill pipes prior to being connected to the drill string, including the cleaning of the threads of the pin and box ends. Such apparatuses and methods would be particularly well received if they could be operated either on a drilling rig, at a pipe inspection plant, or at a machine shop. Such apparatuses and methods would also be particularly well received if they could be operated by hand, would consume a minimum amount of cleaning fluid at a low fluid pressure, and if they are able to clean the threads of the pin and box ends of drill pipe while the drill pipe is in either a vertical or horizontal position with respect to the ground.

BRIEF SUMMARY OF THE DISCLOSURE

An apparatus for servicing tubular members includes a cleaning fluid delivery system, a motor configured to provide rotational movement to the cleaning fluid delivery system, and a cleaning fluid actuator configured to provide pressurized cleaning fluid to the cleaning fluid delivery system. In some embodiments, the cleaning fluid delivery system is configured to direct a jet of cleaning fluid at a non-perpendicular angle relative to a surface of the tubular member. In this embodiment, the cleaning fluid delivery system may be configured to direct a jet of cleaning fluid at an acute angle relative to a surface of the tubular member. In some embodiments, the cleaning fluid delivery system is configured to direct a jet of cleaning fluid towards a threaded coupler of a box end of the tubular member. In certain embodiments, the cleaning fluid delivery system is configured to direct a jet of cleaning fluid towards a threaded coupler of a pin end of the tubular member. In some embodiments, the cleaning fluid delivery system is configured to be operated by hand. In some embodiments, the cleaning fluid delivery system is configured to direct a jet of cleaning fluid towards a threaded coupler of the tubular member when the tubular member is either in a horizontal or a vertical position. In certain embodiments, the apparatus further includes a protective housing including generally cylindrical housing coupled to the cleaning fluid delivery system and disposed about an end of the tubular member, and a centralizer assembly coupled to the cylindrical housing and configured to coaxially align a central axis of an output shaft of the cleaning fluid delivery system and a central axis of the tubular member. In certain embodiments, the centralizer assembly includes a splined member pivotably coupled to an outer surface of the cylindrical housing, and a latch coupled to a flange of the cylindrical housing and configured to releasably couple with the splined member. In some embodiments, the splined member includes one or more splines configured to enter into interlocking engagement a spline of the latch.

An apparatus for servicing tubular members includes a cleaning fluid delivery system, a motor configured to provide rotational movement to the cleaning fluid delivery system, and a cleaning fluid actuator configured to provide pressurized cleaning fluid to the cleaning fluid delivery system, wherein the cleaning fluid delivery system is configured to be operated by hand. In some embodiments, the cleaning fluid delivery system is configured to direct a jet of cleaning fluid at a non-perpendicular angle relative to a surface of the tubular member. In some embodiments, the cleaning fluid delivery system is configured to direct a jet of cleaning fluid at an acute angle relative to a surface of the tubular member. In certain embodiments, the cleaning fluid delivery system is configured to direct a jet of cleaning fluid towards a threaded coupler of a box end of the tubular member. In certain embodiments, the cleaning fluid delivery system is configured to direct a jet of cleaning fluid towards a threaded coupler of a pin end of the tubular member. In some embodiments, the cleaning fluid delivery system is configured to direct a jet of cleaning fluid towards a threaded coupler of the tubular member when the tubular member is either in a horizontal or a vertical position. In some embodiments, the apparatus also includes a protective housing including a generally cylindrical housing coupled to the cleaning fluid delivery system and disposed about an end of the tubular member, and a centralizer assembly coupled to the cylindrical housing and configured to coaxially align a central axis of an output shaft of the cleaning fluid delivery system and a central axis of the tubular member. In some embodiments, the centralizer assembly includes a splined member pivotably coupled to an outer surface of the cylindrical housing, and a latch coupled to a flange of the cylindrical housing and configured to releasably couple with the splined member. In certain embodiments, the splined member includes one or more splines configured to enter into interlocking engagement a spline of the latch.

An apparatus for servicing tubular members includes a cleaning fluid delivery system, a motor configured to provide rotational movement to the cleaning fluid delivery system, a cleaning fluid actuator configured to provide pressurized cleaning fluid to the cleaning fluid delivery system, a movement actuator coupled to the cleaning fluid delivery system and configured to displace the cleaning fluid delivery system between an extended position and an inserted position, and a control system configured to control the actuation of the motor, cleaning fluid actuator, and movement actuator. In some embodiments, the control system includes an actuator valve coupled to the movement actuator and configured to control the actuation of the movement actuator, and a cleaning fluid valve coupled to the motor and cleaning fluid actuator and configured to control the actuation of the motor and cleaning fluid actuator. In some embodiments, the actuator valve and the cleaning fluid valve each include a valve configured to be actuated by an operator. In certain embodiments, the actuator valve and the cleaning fluid valve are each configured to be actuated by a computer. In certain embodiments, the cleaning fluid valve is configured to control the amount of power provided to the motor and the amount of fluid provided to the cleaning fluid delivery system. In some embodiments, a nozzle of the cleaning fluid delivery system is disposed axially adjacent to a threaded coupler of the tubular member when the cleaning fluid delivery system is in the inserted position. In some embodiments, the cleaning fluid delivery system is configured to direct a jet of cleaning fluid at a non-perpendicular angle relative to a surface of the tubular member. In certain embodiments, the apparatus also includes an actuator controller configured to control the rate of actuation of the actuator.

It is to be understood that both the foregoing general description and the following detailed description are exemplary of the disclosure and are intended to provide an overview or framework for understanding the nature and character of the apparatuses and methods that are disclosed and claimed. The accompanying drawings are included to provide a further understanding of the disclosure and are incorporated in and constitute a part of this specification. The drawings illustrate various exemplary embodiments of the disclosure and together with the written description serve to explain certain principles and operation of the disclosed embodiments.

BRIEF DESCRIPTION OF THE DRAWINGS

The following is a description of the figures in the accompanying drawings. The figures are not necessarily to scale, and certain features and certain views of the figures may be shown exaggerated in scale or in schematic in the interest of clarity and conciseness.

DETAILED DESCRIPTION

Figure 1:
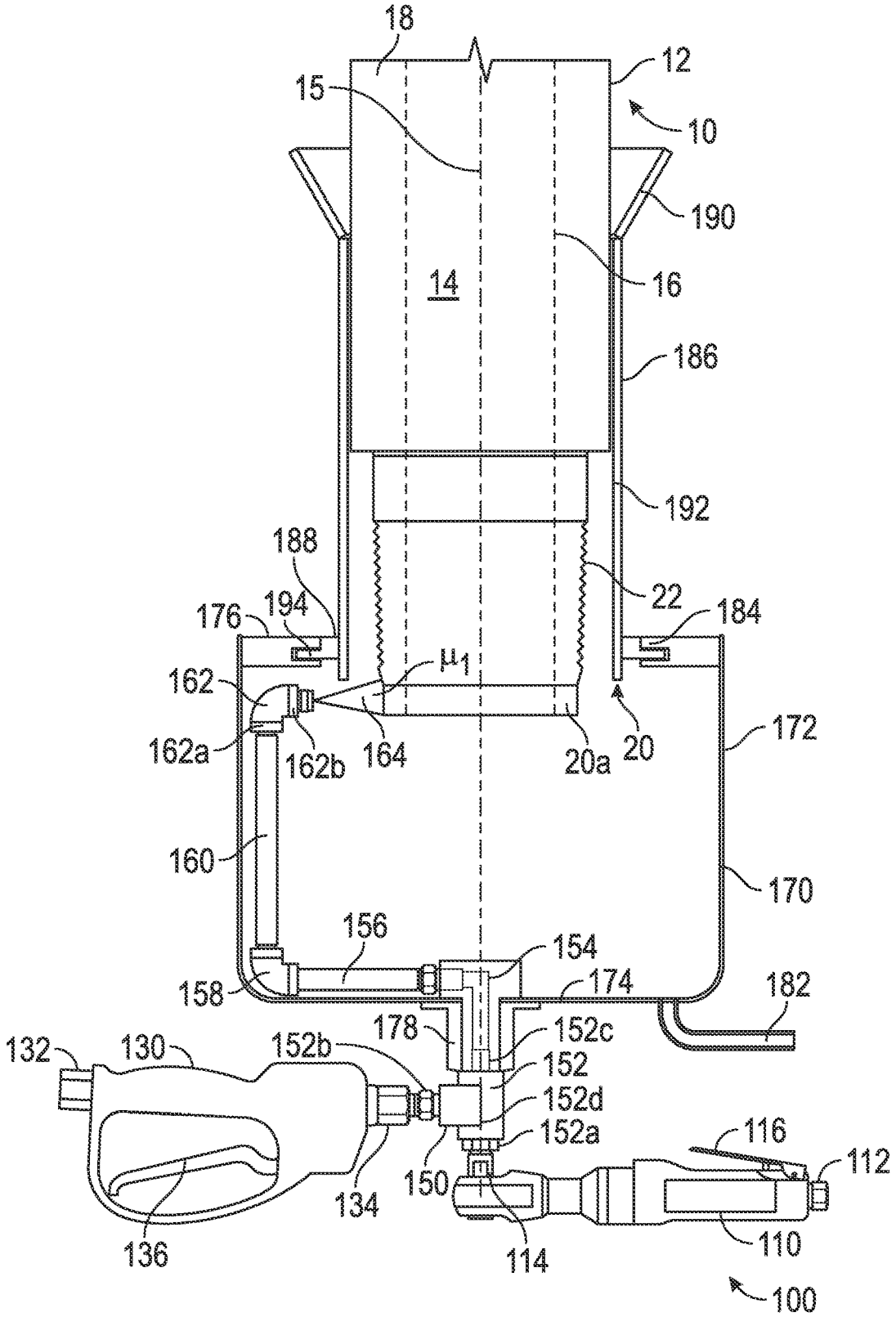
FIG. 1 is a side, partial cross-sectional view of an embodiment of a pin end thread cleaning device in accordance with principles discussed herein.

In the following detailed description, numerous specific details may be set forth in order to provide a thorough understanding of various embodiments of the disclosure. However, it will be clear to one skilled in the art when embodiments of the disclosure may be practiced without some or all of these specific details. In other instances, well-known features or processes may not be described in detail so as not to unnecessarily obscure the disclosure. In addition, like or identical reference numerals may be used to identify common or similar elements.

An embodiment of a thread cleaning device of the present disclosure is generally configured to service tubular members. More particularly, an embodiment of a thread cleaning device is configured to clean the coupling members disposed at the axial ends of tubular members. For instance, tubular members may include individual pipe joints for coupling with a drill string, where each individual pipe joint includes "pin" or pin end and a "box" or box end, and where the pin end is configured to be inserted into and couple with the box end of an adjoining pipe joint via coupling members of the pin and box ends. An embodiment of the thread cleaning device is configured to clean the coupling members of the pin and box ends of a tubular member such that damage to the coupling members of the pin and box ends may be prevented during coupling and decoupling the respective ends of the tubular members. In an embodiment, the coupling members of the pin and box ends of a tubular member may be threaded couplers configured for threadable engagement. However, in other embodiments the coupling members of the pin and box ends of the tubular members may be other types of couplers, such as splines or other couplers configured to allow for a breakable or decouplable connection.

An embodiment of a thread cleaning device of the present disclosure is configured to clean the threaded couplers of the pin and box ends of a tubular member while the tubular member is either in a vertical or horizontal orientation with respect to the ground. This embodiment of a thread cleaning device is also configured to be operable by hand, and by a single person. This embodiment of a thread cleaning device is also configured to be operable to clean the threaded couplers of tubular members while on a drilling rig, at a pipe inspection facility, a machine shop, or other locations, and is further configured to minimize the amount of cleaning fluid, such as water, and the fluid pressure necessary to clean the threaded couplers of the pin and box ends of a tubular member.

In another embodiment, a thread cleaning machine of the present disclosure is configured to clean the threaded couplers of the pin and box ends of a tubular member using a thread cleaning control system. For instance, in an embodiment the thread cleaning machine includes a nozzle that may be actuated between an extended position and an inserted position through the actuation of a valve. In this embodiment, the valve may be actuated either manually by an operator or automatically through an algorithm or program executed by a computer or other processing device.

Referring now to FIG. 1, an embodiment of a thread cleaning device 100 is shown. In this embodiment, thread cleaning device 100 is generally configured to service a tubular member 10. Tubular member 10 generally includes a generally tubular body 12 defined by an outer surface 18 and having a central or longitudinal axis 15, and a central bore 14 extending axially through the body 12 defined by an inner surface 16. Tubular member 10 also includes a pin or pin end 20 disposed at an axial end of body 12, where pin end 20 includes an end 20*a* and a threaded coupler 22 disposed on the outer surface 18 of the body 12 of member 10. In this embodiment, threaded coupler 22 comprises one or more threads extending circumferentially and axially along outer surface 18 of body 12. While in this embodiment tubular member 10 is described as having a pin end 20 having a threaded coupler 22, in other embodiments tubular member 10 could include other types of coupling members, such as splines, and the like, disposed at pin end 20.

Thread cleaning device 100 generally includes a motor 110, a cleaning fluid actuator 130, a cleaning fluid delivery system 150, and a protective housing 170. Motor 110 is configured to provide power to assembly 100, and in particular, to provide rotational motion to the cleaning fluid delivery system 150 such that it may rotate about pin end 20 of tubular member 10. Motor 110 generally includes an input 112, an output 114, and a lever or actuator 116. Input 112 receives power from a power source coupled to motor 110 and output 114 outputs rotational torque to the delivery system 150. Thus, motor 110 is configured to convert the power received at input 112 into rotational power or torque at output 114. Lever 116 is configured to control the actuation of torque produced at output 114. In this embodiment, motor 110 is a pneumatic wrench; however, in other embodiments motor 110 may be another type of motor configured to provide torque to fluid delivery system 150, such as an electric motor, hydraulic motor, a hand crank, or other types.

Cleaning fluid actuator 130 is configured to provide cleaning fluid delivery system 150 with a stream of pressurized cleaning fluid for cleaning the threaded coupler 22 of tubular member 10. Cleaning fluid actuator 130 generally includes an input 132, an output 134, and a lever or actuator 136. Input 132 receives pressurized cleaning fluid from a cleaning fluid source coupled to actuator 136 via input 132, and output 134 provides pressurized cleaning fluid to fluid delivery system 150. Lever 136 is configured to control the supply of pressurized cleaning fluid to output 134 of actuator 136. In this embodiment, cleaning fluid actuator 130 provides a supply of water to fluid delivery system 150; however, in other embodiments cleaning fluid actuator 130 may provide other fluids for cleaning the thread assembly 22 of tubular member 10. In this embodiment, cleaning fluid actuator 130 provides cleaning fluid at approximately 3,000 pounds per square inch (PSI) and at a flow rate of approximately four gallons per minute (GPM); however, in other embodiments cleaning fluid actuator 130 may provide cleaning fluid at other pressures and flow rates.

Cleaning fluid delivery system 150 is configured to clean the threaded coupler 22 of tubular member 10. More particularly, fluid delivery system 150 is configured to direct a high pressure spray of fluid evenly against the substantial entirety of the threaded coupler 22. For instance, fluid delivery system 150 is configured to provide a pressurized jet of fluid directed towards threaded coupler 22 that moves axially relative tubular member 10 and circumferentially 360° about the surface 12 of coupler 22. Fluid delivery system 150 generally includes a rotary swivel 152, a first elbow 154, a first conduit 156, a second elbow 158, a second conduit 160, and a third elbow 162. The swivel 152 is configured to receive the rotational motion or torque provided by output 114 of motor 110 and pressurized cleaning fluid supplied by output 134 of cleaning fluid actuator 130. Swivel 152 includes a rotational connection 152*a*, a fluid supply input 152*b*, and an output shaft 152*c*. Output shaft 152*c* has a central or longitudinal axis 152*d* and is disposed within swivel 152. An axial end of shaft 152*c* couples to motor 110 at rotational connection 152*a*, which provides torque and rotational motion to output shaft 152*c*. Pressurized cleaning fluid is provided to the interior of output shaft 152*c* via fluid supply input 152*b*, where cleaning fluid flows into swivel 152 through input 152*b* and into output shaft 152*c* through ports (not shown) extending radially into shaft 152*c*.

When lever 116 of motor 110 and lever 136 of fluid actuator 130 are each actuated, output shaft 152*c* is both rotated and acts as a conduit for a flow of pressurized cleaning fluid. Output shaft 152*c* is directly coupled to first elbow 154, which converts the rotational motion of shaft 152*c* into arcuate or circumferential motion about longitudinal axis 15 of tubular member 10. First elbow 154 couples to first conduit 156, which increases the radius of the arcuate motion provided by elbow 154. First conduit couples to second elbow 158, which in turn couples to second conduit 160, which extends the fluid delivery system 150 axially (with respect to axis 15) towards threaded coupler 22 of tubular member 10. Second conduit 160 couples to third elbow 162, which directs the path of the pressurized cleaning fluid flowing through elbows 154, 158, and conduits 156, 160, towards threaded coupler 22 of tubular member 10, in a direction perpendicular to longitudinal axis 15.

Figure 6:
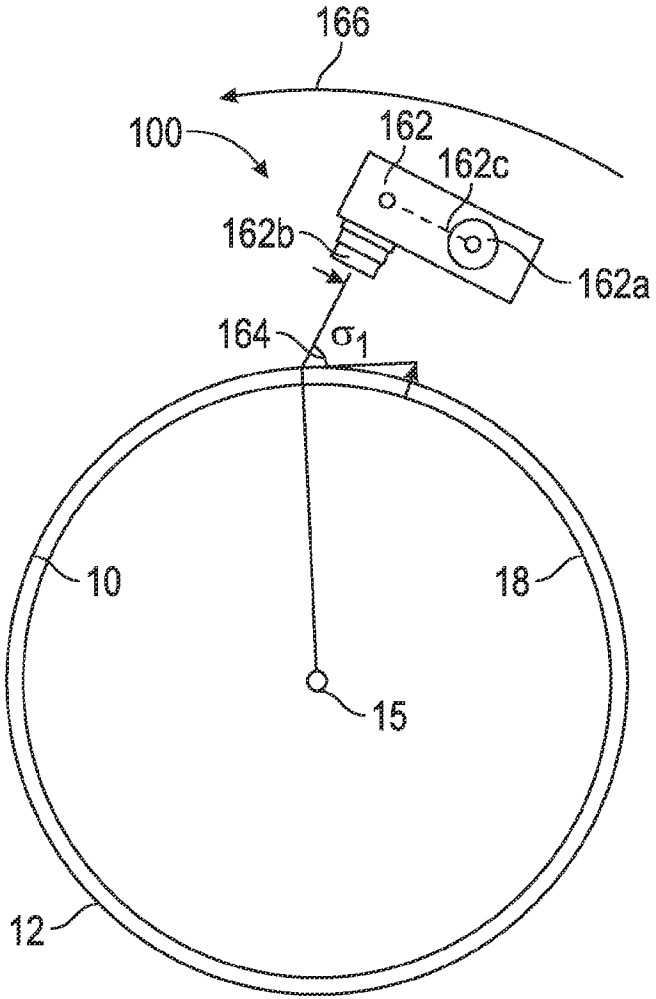
FIG. 6 is a top, cross-sectional view of the thread cleaning device of FIG. 1.

Referring now to FIGS. 1 and 6, third elbow 162 is configured to direct a jet of cleaning fluid 164 perpendicularly towards the surface 12 of threaded coupler 22 of tubular member 10. Third elbow 162 is also configured to direct the jet of fluid 164 at an offset angle $\sigma_1$ from longitudinal axis 15, as shown in FIG. 6. The offset angle $\sigma_1$ is angled towards the direction or against the direction of relative rotation 166 (clockwise in FIG. 6) between tubular member 10 and nozzle 162*b*. In an embodiment, the offset angle $\sigma_1$ is approximately 60°; however, in other embodiments the offset angle $\sigma_1$ may be other acute angles, such as acute angles between 50°-70°. Further, the offset angle $\sigma_1$ may be adjusted depending upon the application. For instance, a different offset angle $\sigma_1$ may be desirable when servicing different types of couplers (e.g., different diameters, different types of threaded couplers, etc.) of tubular member 10. Third elbow 162 generally includes an inlet 162*a*, a nozzle 162*b*, and a circumferential offset 162*c* extending between inlet 162 and nozzle 162*b*. Third elbow receives pressurized cleaning fluid from second conduit 160 via inlet 162*a*. Nozzle 162*b* is configured to eject the jet of cleaning fluid 164 at a high velocity towards threaded coupler 22 of tubular member 10. Further, as shown in FIG. 1, nozzle 162*b* is configured to form a spray 164 that covers an axial portion of the outer surface 12 of tubular member 10. The offset angle $\sigma_1$ is achieved through the circumferential offset 162*c* extending between inlet 162*a* and nozzle 162*b*. Thus, the offset angle $\sigma_1$ may be greatened through the lengthening of circumferential offset 162*c*, and decreased through the shortening of offset 162*c*. However, in other embodiments nozzle 162*b* may be directed at an angle with respect to surface 12 of tubular member 10 without the use of offset 162*c*.

Referring again to FIG. 1, protective housing 170 generally includes a first or upper housing 172 and a second or lower housing 186. Upper housing 172 is generally configured to retain the high velocity jet of cleaning fluid 164 within housing 170, protecting the operator of the cleaning fluid assembly 100 from injury. Lower housing 186 is configured to help centralize cleaning fluid assembly 100 with the tubular member 10 such that the longitudinal axis 152*d* of output shaft 152*c* of swivel 152 is disposed substantially coaxial with longitudinal axis 15 of tubular member 10. Upper housing 172 generally includes a first or upper flange 174 and a second or lower flange 176 axially displaced from upper flange 174. Upper flange 174 of housing 172 includes an annular coupler 178 that extends axially from upper flange 174 and couples to fluid delivery system 150 at swivel 152. Annular coupler 178 is disposed coaxially with longitudinal axis 152*d* of output shaft 152*c*, thus centralizing upper housing 172 and protective housing 170 with fluid delivery system 150. Upper flange 174 of upper housing 172 also includes a drain 182 for draining cleaning fluid at a low velocity from protective housing 170. Although thread cleaning device 100 may be used in vertical or horizontal positions, in the embodiment shown in FIG. 1, assembly 100 is used in a vertical position, with assembly 100 disposed vertically below pin end 20 of tubular member 10. In this position, cleaning fluid may flow into drain 182 and out of housing 170 via gravity. Also, drain 182 may be coupled to tubing that extends to a drainage receptacle, such as a bucket and the like. While in this embodiment upper housing 172 includes drain 182, in other embodiments the protective housing 170 may not include a drain. Lower flange 176 extends radially inward from upper housing 172 and includes a female connector 184 disposed at the radially inner edge of lower flange 176.

Lower housing 186 includes a first or upper flange 184 and a conical shroud 190 axially displaced from upper flange 188. Upper flange 188 extends radially outward from lower housing 186 and includes a male connector 194 configured for mating engagement with the female connector 184 of upper housing 172. Shroud 190 is conically shaped to allow convenient insertion of pin end 20 of tubular member 10 into protective housing 170 of thread cleaning device 100. Lower housing 186 also includes a generally cylindrical inner surface 192 having a diameter substantially similar to the outer diameter of outer surface 12 of tubular member 10 proximal pin end 20, as shown in FIG. 1. Given, in this embodiment, the similarity in diameter between inner surface 192 of lower housing 186 and outer surface 12 of tubular member 10, there is sliding engagement between inner surface 192 and outer surface 12 when tubular member 10 is disposed within protective housing 170. The sliding engagement between inner surface 192 and outer surface 12 centralizes the protective housing 170 such that the protective housing 170 is disposed coaxially with longitudinal axis 15 of tubular member 10. Although in the embodiment shown in FIG. 1 the protective housing 170 does not rotate, and is instead stationary with respect to tubular member 10, in other embodiments the protective housing may rotate in unison with the output shaft 152*c*, first elbow 154, first conduit 156, second elbow 158, second conduit 160, and third elbow 162, as described further herein.

Figure 2:
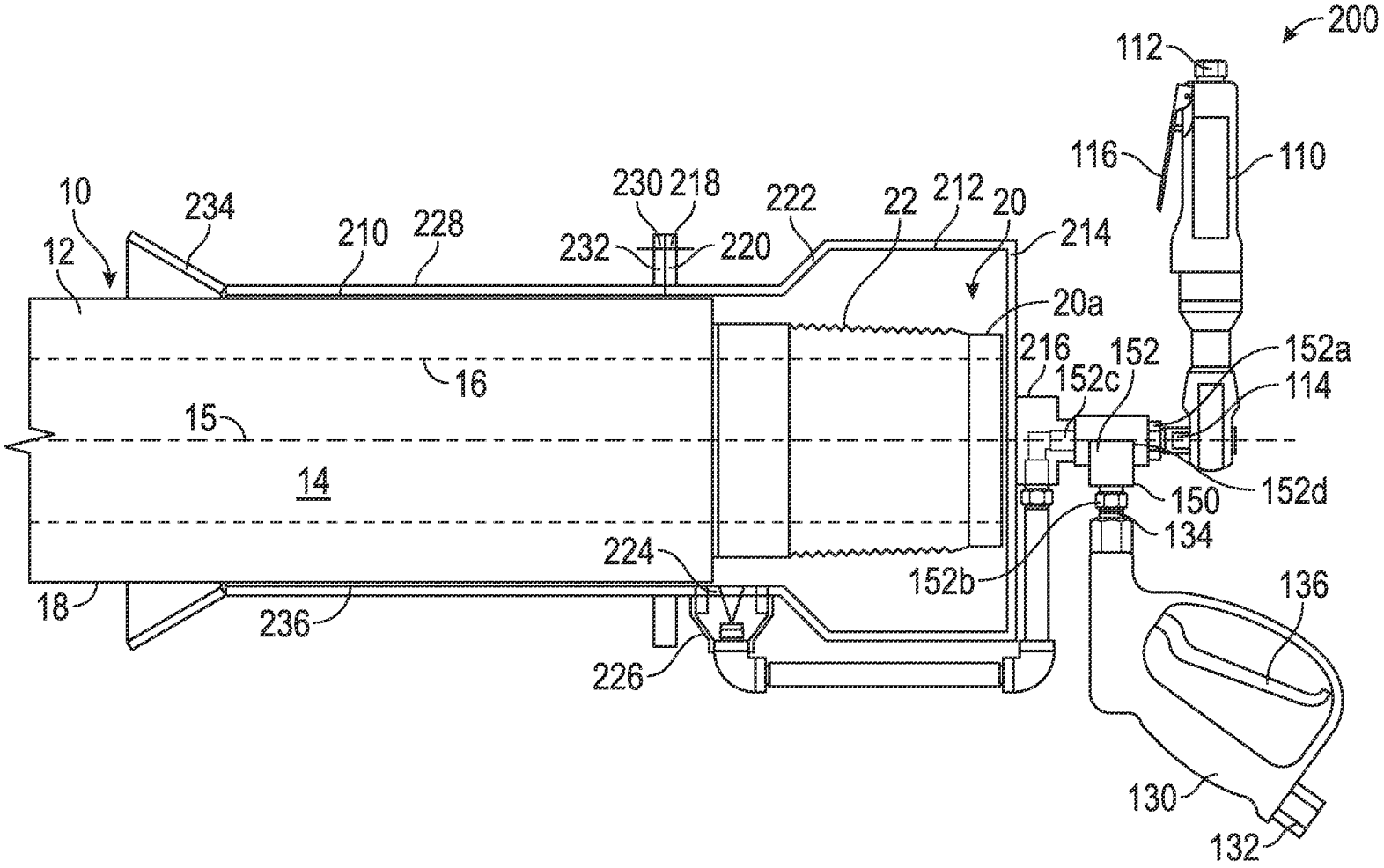
FIG. 2 is a side, partial cross-sectional view of another embodiment of a pin end thread cleaning device in accordance with principles discussed herein.

Referring to FIG. 2, another embodiment of a thread cleaning device 200 (shown in a horizontal position) configured to service tubular member 10 is shown. Thread cleaning device 200 generally includes motor 110, cleaning fluid actuator 130, cleaning fluid delivery system 150, and a protective housing 210. Unlike protective housing 170 of thread cleaning device 100, the protective housing 210 of thread cleaning device 200 is configured to rotate in unison with output shaft 152*c* of swivel 152. Also unlike protective housing 170, in the embodiment of thread cleaning device 200, third elbow 162 is partially disposed external of protective housing 210.

Protective housing 210 generally includes a first or upper housing 212 and a second or lower housing 228. Upper housing 212 is generally configured to retain the high velocity jet or fan of cleaning fluid 164 within housing 210, protecting the operator of the cleaning fluid assembly 200 from injury. Cleaning fluid velocity jet 164 includes a fan angle $\mu_1$ of approximately 25°; however, in other embodiments fan angle $\mu_1$ may be variable depending upon the application Lower housing 228 is configured to help centralize cleaning fluid assembly 200 with the tubular member 10 such that the longitudinal axis 152*d* of output shaft 152*c* of Swivel 152 is disposed substantially coaxial with longitudinal axis 15 of tubular member 10.

Upper housing 212 generally includes a first or upper flange 214 and a second or lower flange 218 axially displaced from upper flange 212. Upper flange 214 of housing 212 includes an annular coupler 216 that extends axially from upper flange 214 and couples to output shaft 152*c* of fluid delivery system 150. Annular coupler 216 is disposed coaxially with longitudinal axis 152*d* of output shaft 152*c*, thus centralizing upper housing 212 and protective housing 210 with fluid delivery system 200. Coupler 216 is configured to transfer rotational motion from output shaft 152*c* of swivel 152 to upper housing 212 and protective housing 210, thus allowing protective housing 210 to rotate in unison with third elbow 162 and nozzle 162*b*. Lower flange 218 of upper housing 212 extends radially outward from housing 212 and includes a plurality of circumferentially spaced apertures 220 extending therethrough.

Upper housing 212 also includes an axially extending conical section 222 and a radial port 224 disposed proximal the nozzle 162*b* of third elbow 162 and configured to allow the passage of cleaning fluid jet 164 into the interior of protective housing 210. Upper housing 212 further includes a receptacle 226 disposed about radial port 224 and configured to receive the nozzle 162*b* of third elbow 162. Thus, as protective housing 210 and third elbow 162 of cleaning fluid delivery system 150 rotate in unison during operation, the cleaning fluid jet 164 may flow through radial port 224 and contact the threaded coupler 22 of tubular member 10.

Referring still to FIG. 2, lower housing 228 includes a first or upper flange 230 and a conical shroud 234 axially displaced from upper flange 230. Upper flange 230 extends radially outward from lower housing 228 and includes a plurality of circumferentially spaced apertures 232, where a plurality of bolts may be passed through each pair of proximally disposed apertures 220 and 232 of upper and lower housings 212 and 228, respectively, to couple upper housing 212 to lower housing 228. Shroud 234 is conically shaped to allow convenient insertion of pin end 20 of tubular member 10 into protective housing 210 of thread cleaning device 200. Lower housing 228 also includes a generally cylindrical inner surface 236 having a diameter substantially similar to the outer diameter of outer surface 12 of tubular member 10 proximal pin end 20, as shown in FIG. 2. Given the similarity in diameter between inner surface 236 of lower housing 228 and outer surface 12 of tubular member 10, there is sliding engagement in this embodiment between inner surface 236 and outer surface 12 when tubular member 10 is disposed within protective housing 210. The sliding engagement between inner surface 236 and outer surface 12 centralizes the protective housing 210 such that the protective housing 210 is disposed coaxially with longitudinal axis 15 of tubular member 10.

Figure 3:
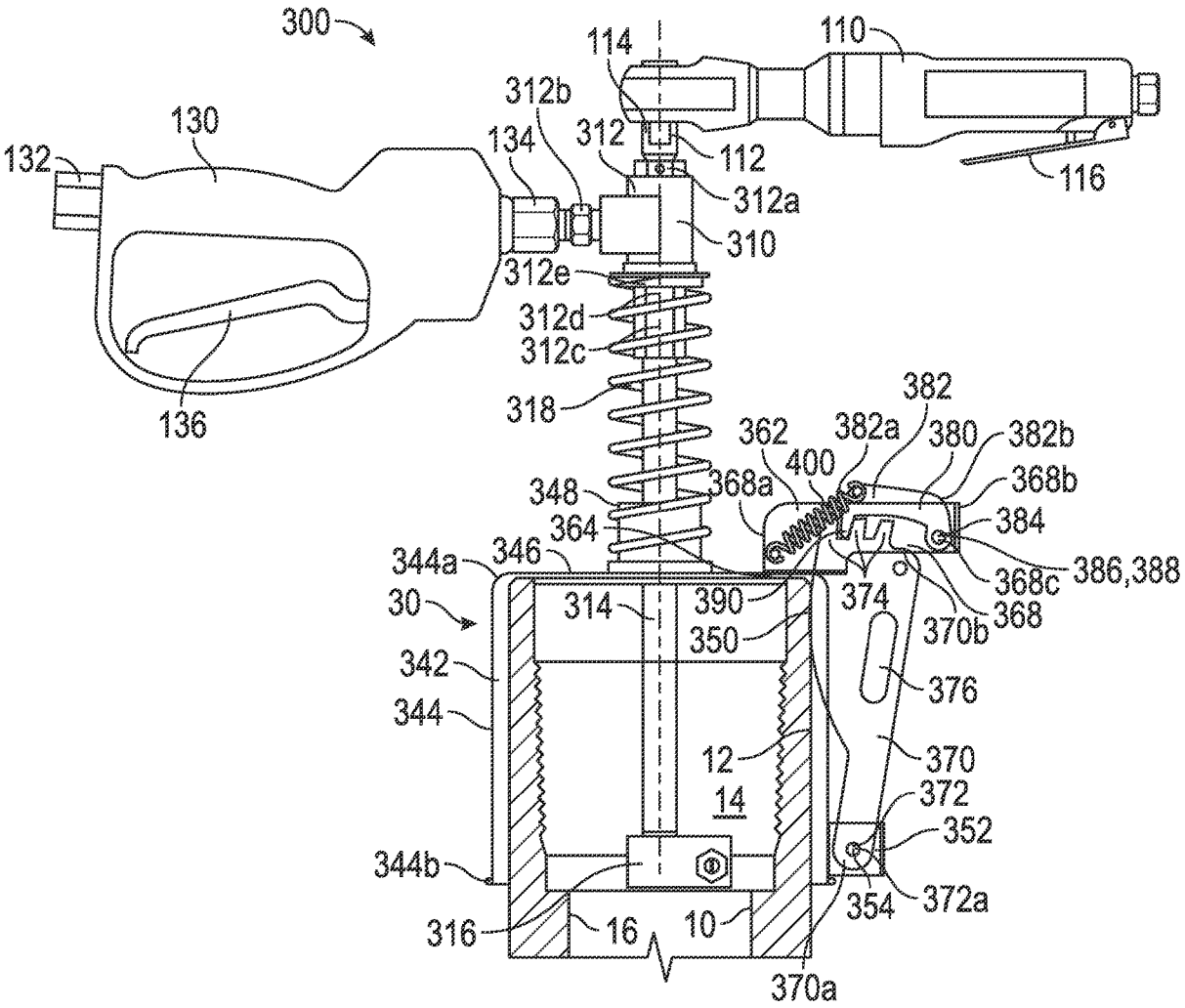
FIG. 3 is a side, partial cross-sectional view of an embodiment of a box end thread cleaning device in accordance with principles discussed herein.

Referring to FIG. 3, an embodiment of a thread cleaning device 300 is shown. A box or box end 30 is disposed on the opposing axial end of tubular member 10 from pin end 20. Box end 30 of tubular member 10 includes an axial end 30*a* and a threaded coupler 32 comprising one or more threads disposed on the inner surface 16 of central bore 14. While in this embodiment tubular member 10 is described as having a box end 30 having a threaded coupler 32, in other embodiments tubular member 10 could include other types of coupling members, such as splines, and the like, disposed at box end 30. In this embodiment, thread cleaning device 300 is generally configured to service the box end 30 of tubular member 10. In particular, thread cleaning device 300 is configured to clean the threaded coupler 32 of box end 30.

Thread cleaning device 300 generally includes motor 110, cleaning fluid actuator 130, a cleaning fluid delivery system 310, and a protective housing 340. As described above, motor 110 is configured to provide torque and rotational motion to cleaning fluid delivery system 310 and cleaning fluid actuator 130 is configured to provide pressurized cleaning fluid to fluid delivery system 310. Cleaning fluid delivery system 310 is configured to clean the threaded coupler 32 of tubular member 10. More particularly, fluid delivery system 310 is configured to direct a high pressure spray of fluid evenly against the substantial entirety of the threaded coupler 32. For instance, fluid delivery system 310 is configured to provide a pressurized jet of fluid directed towards threaded coupler 32 that moves axially relative tubular member 10 and circumferentially 360° about the inner surface 16 of coupler 32.

Fluid delivery system 310 generally includes a swivel 312, a conduit 314, an elbow 316, and a biasing spring 318. The swivel 312 is configured to receive the rotational motion or torque provided by output 114 of motor 110 and pressurized cleaning fluid supplied by output 134 of cleaning fluid actuator 130. Similar to swivel 152 of thread cleaning assemblies 100 and 200, swivel 312 includes a rotational connection 312*a*, a fluid supply input 312*b*, and an output shaft 312*c*. Output shaft 312*c* has a central or longitudinal axis 312*d* and is disposed within swivel 312. An axial end of shaft 312*c* couples to motor 110 at rotational connection 312*a*, which provides torque and rotational motion to output shaft 312*c*. Pressurized cleaning fluid is provided to the interior of output shaft 312*c* via fluid supply input 312*b*, where cleaning fluid flows into swivel 312 through input 312*b* and into output shaft 312*c* through ports (not shown) extending radially into shaft 312*c*.

When lever 116 of motor 110 and lever 136 of fluid actuator 130 are each actuated, output shaft 312*c* is both rotated and acts as a conduit for a flow of pressurized cleaning fluid. Output shaft 312*c* is directly coupled to conduit 314 which extends the fluid delivery system 310 axially (with respect to axis 15) into central bore 14 and proximal threaded coupler 32 of tubular member 10. Conduit 314 couples to elbow 316, which directs the path of the pressurized cleaning fluid flowing through conduit 314 radially outward towards threaded coupler 32 of tubular member 10, and in a direction perpendicular to longitudinal axis 15. Biasing member 318 is configured to support the weight of thread cleaning device 300, particularly motor 110, cleaning fluid actuator 130, and cleaning fluid delivery system 310, as will be discussed further herein.

Figure 4:
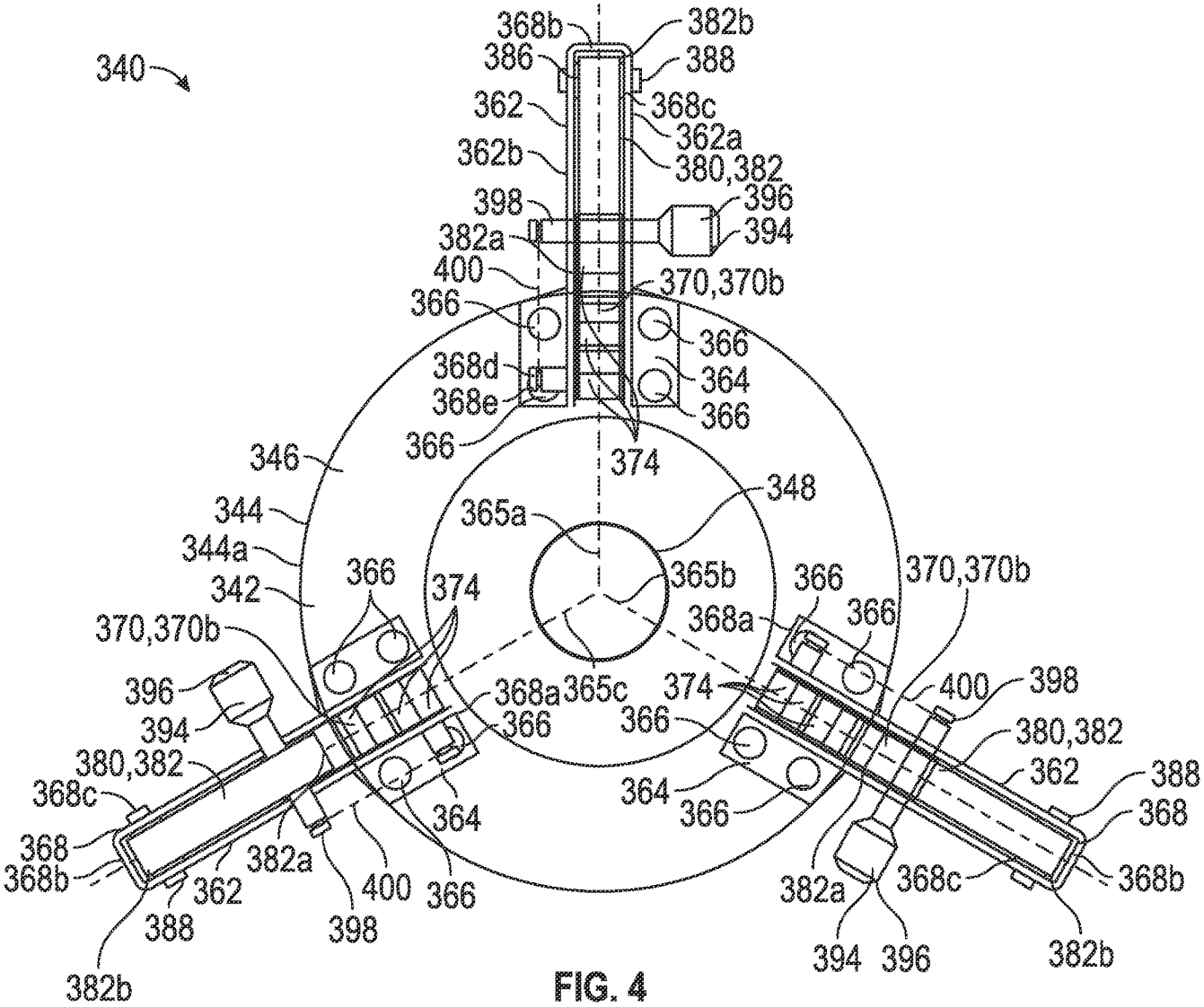
FIG. 4 is a top view of an embodiment of a centralizer assembly of the thread cleaning device of FIG. 3 in accordance with principles discussed herein.
Figure 5B:
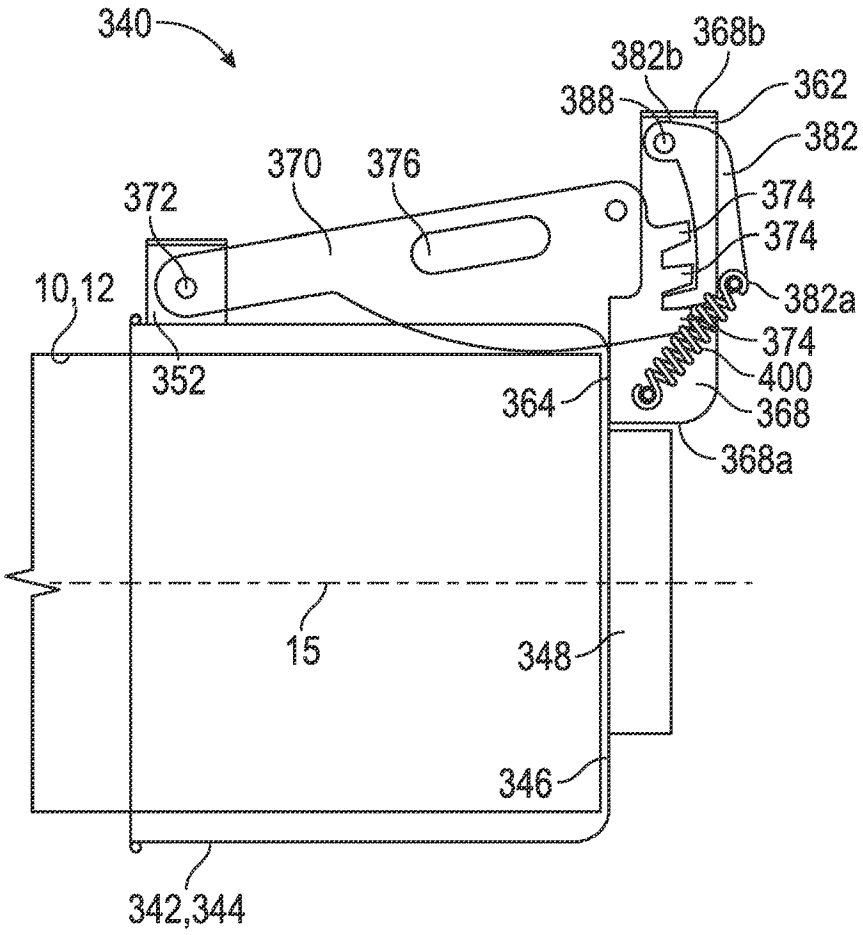
FIGS. 5A-5D are side, cross-sectional views of the centralizer assembly of FIG. 4.
Figure 5A:
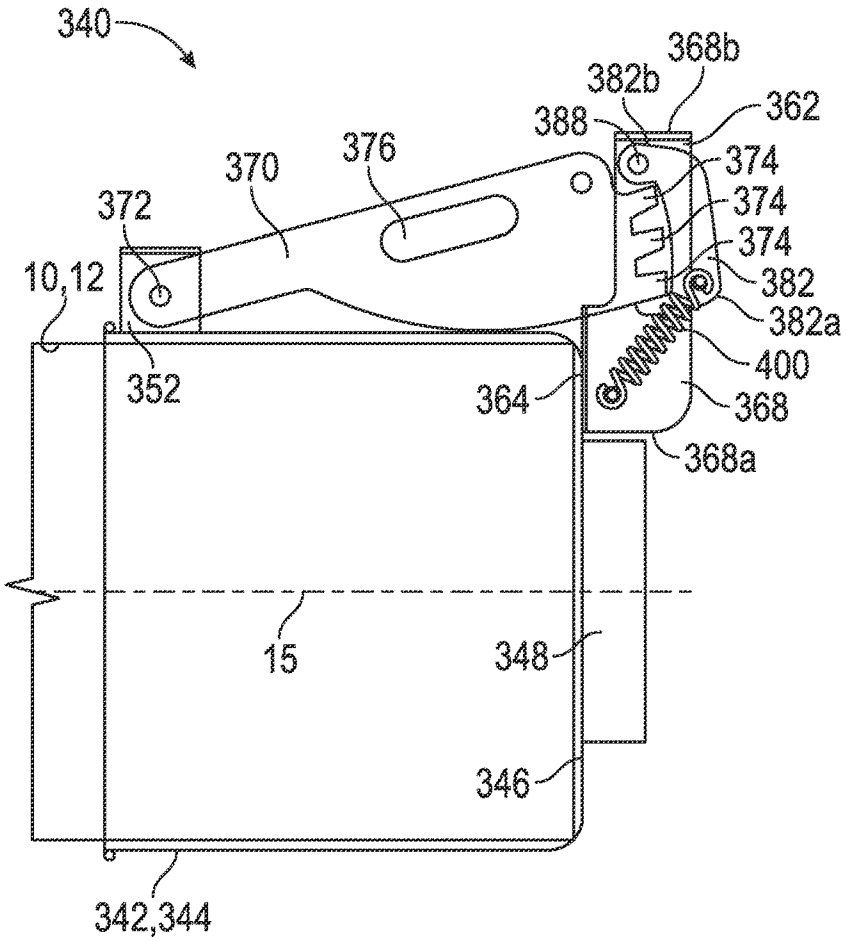
Figure 5D:
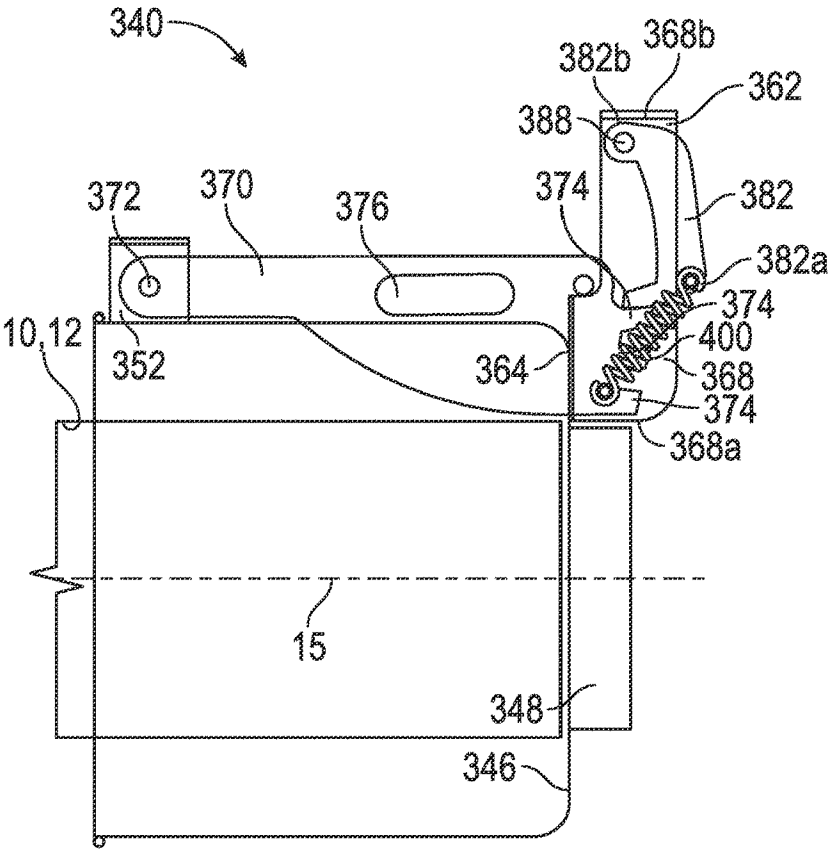
Figure 5C:
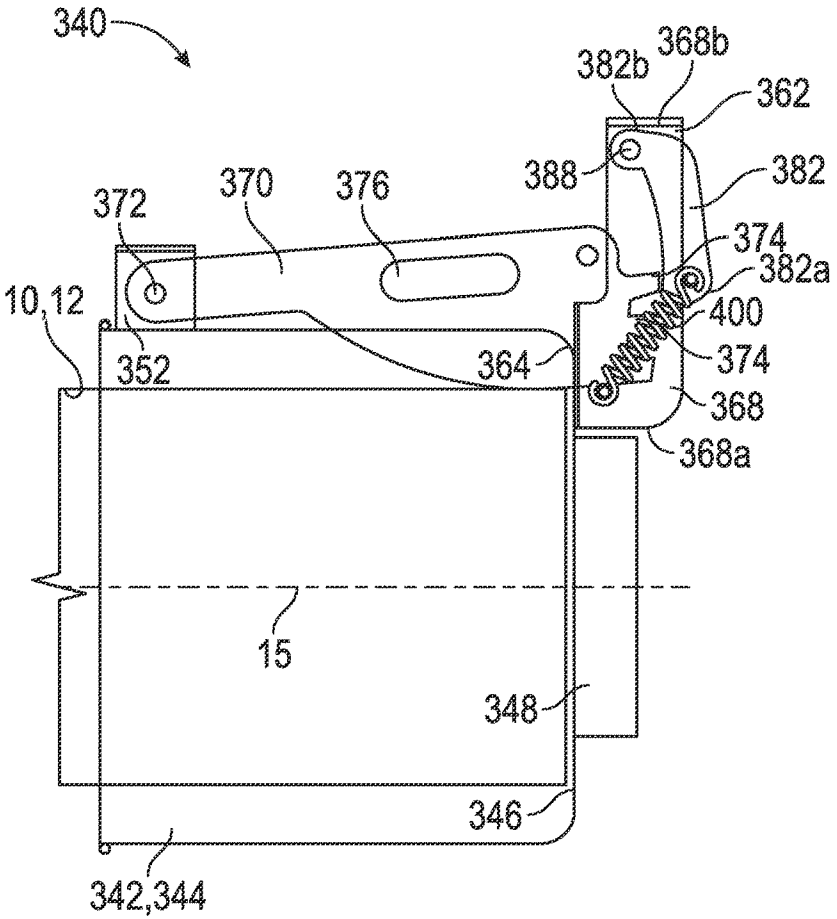
Figure 7:
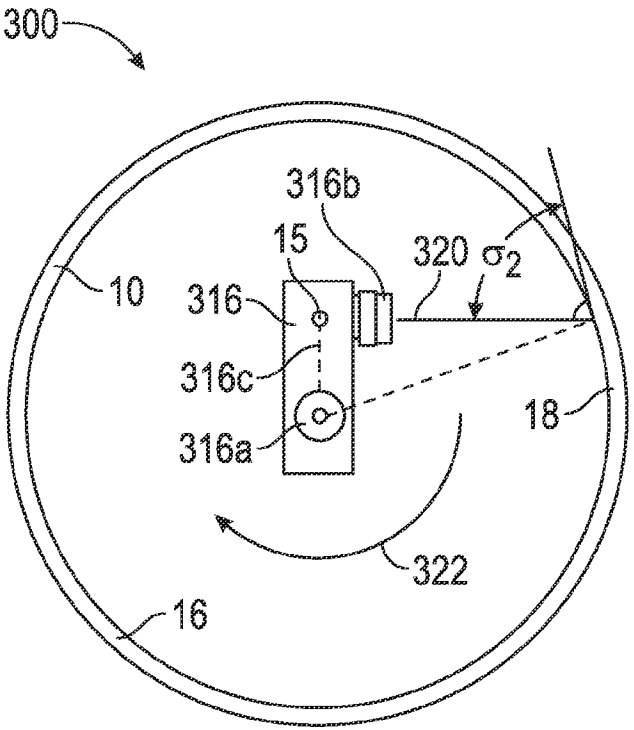
FIG. 7 is a top, cross-sectional view of the thread cleaning device of FIG. 3.
Figure 9:
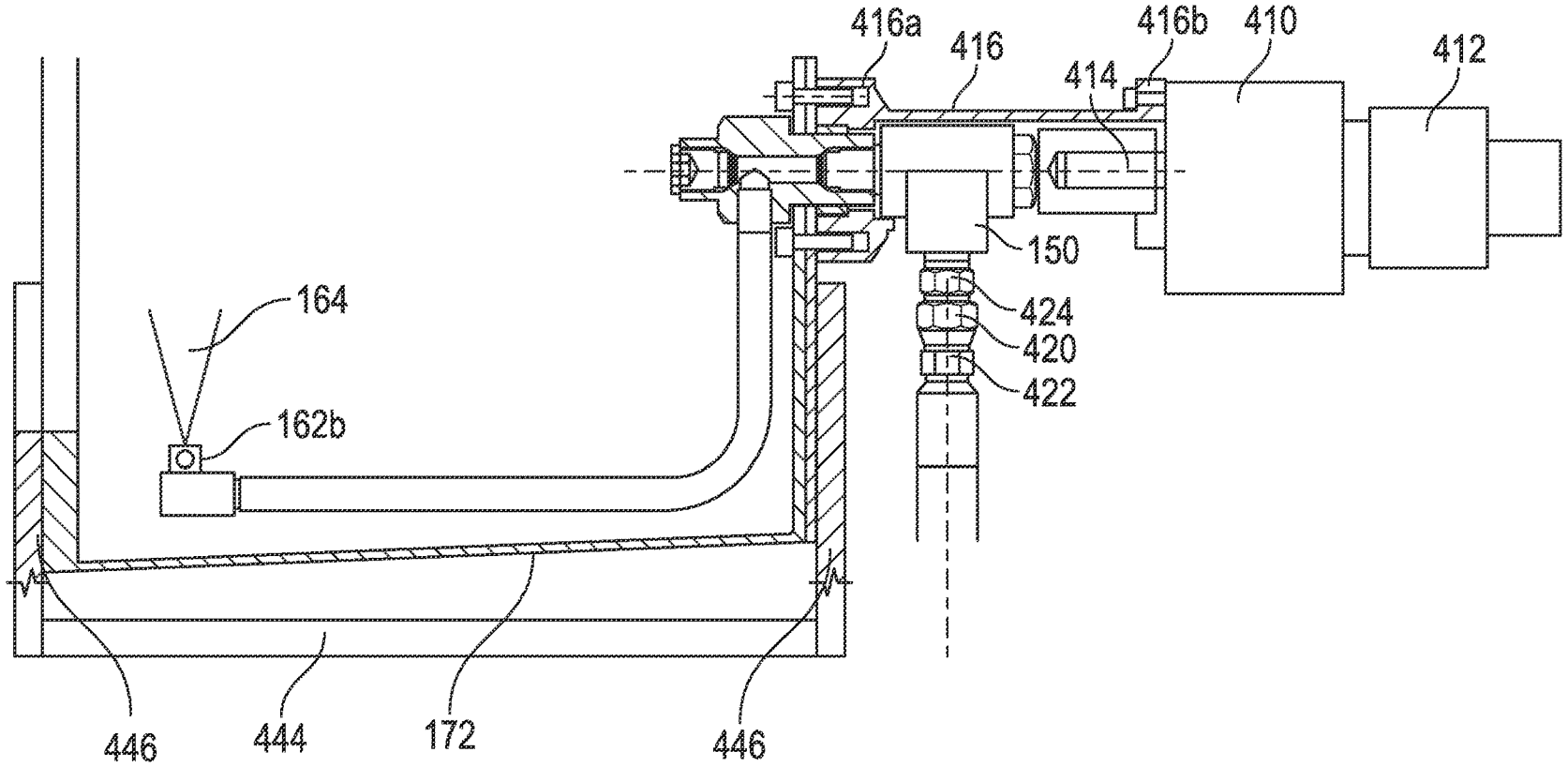
FIG. 9 is an enlarged, partial cross-sectional view of the thread cleaning device shown in FIGS. 8A and 8B.
Figure 10:
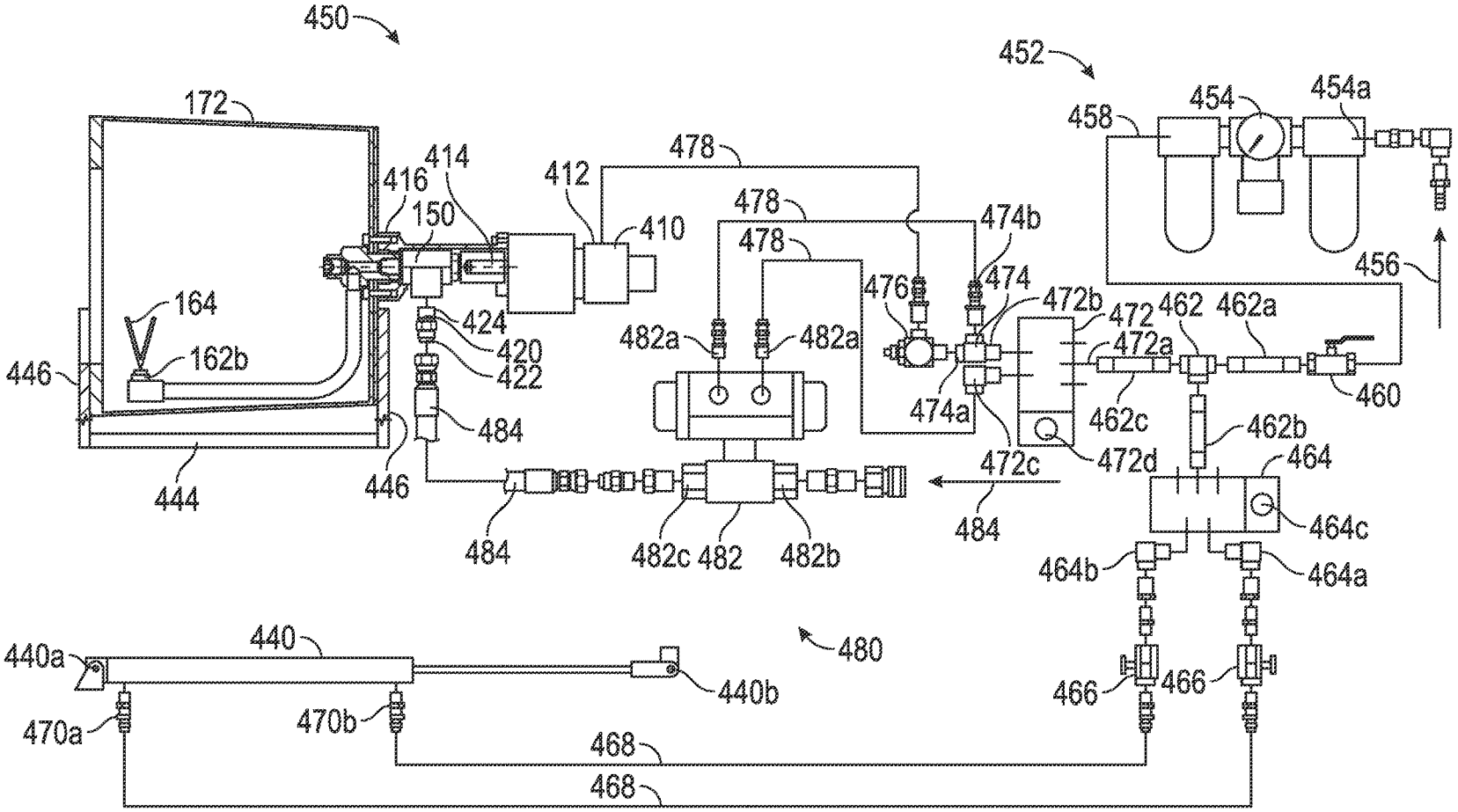
FIG. 10 is a schematic view of a thread cleaning control system of the thread cleaning device of FIGS. 8A and 8B.

Referring now to FIGS. 3 and 9, elbow 316 is configured to direct a jet of cleaning fluid 320 perpendicularly towards the surface 12 of threaded coupler 32 of tubular member 10. Elbow 316 is also configured to direct the jet of fluid 320 at an offset angle $\sigma_2$ from longitudinal axis 15, as shown in FIG. 9. The offset angle $\sigma_2$ is angled towards the direction or against the direction of relative rotation 322 (clockwise in FIG. 9) between tubular member 10 and nozzle 316*b*. In an embodiment, the offset angle $\sigma_2$ is approximately 60°; however, in other embodiments the offset angle $\sigma_2$ may be other acute angles, such as acute angles between 50°-70°. Further, the offset angle $\sigma_1$ may be adjusted depending upon the application. For instance, a different offset angle $\sigma_1$ may be desirable when servicing different types of couplers (e.g., different diameters, different types of threaded couplers, etc.) of tubular member 10. Elbow 316 generally includes an inlet 316*a*, a nozzle 316*b*, and a circumferential offset 316*c* extending between inlet 316 and nozzle 316*b*. Elbow 316 receives pressurized cleaning fluid from conduit 314 via inlet 316*a*. Nozzle 316*b* is configured to eject the jet of cleaning fluid 320 at a high velocity towards threaded coupler 32 of tubular member 10. Further, as shown in FIG. 3, nozzle 316*b* is configured to form a spray 320 that covers an axial portion of the inner surface 16 of tubular member 10. The offset angle $\sigma_2$ is achieved through the circumferential offset 316*c* extending between inlet 316*a* and nozzle 316*b*. Thus, the offset angle $\sigma_2$ may be increased through the lengthening of circumferential offset 316*c*, and decreased through the shortening of offset 316*c*. However, in other embodiments nozzle 162*b* may directed at an angle with respect to surface 12 of tubular member 10 without the use of offset 162*c*. Referring to FIGS. 3 and 4, protective housing 340 generally includes a housing 342 and a centralizer assembly 360. Housing 342 is generally configured to retain the high velocity jet of cleaning fluid 320 within housing 342, thus protecting the operator of the cleaning fluid assembly 100 from injury. Centralization assembly 360 is configured to help centralize cleaning fluid assembly 300 with the tubular member 10 such that the longitudinal axis 312*d* of output shaft 312*c* of Swivel 312 is disposed substantially coaxial with longitudinal axis 15 of tubular member 10. Housing 342 includes a generally cylindrical body 344 having a first or upper end 344*a* and a second or lower end 344*b*, with a flange 346 disposed at upper end 344*a* of body 344. Flange 346 of housing 342 includes an annular coupler 348 extending axially upward from upper flange 174 and couples to fluid delivery system 310 via biasing member 318.

Referring still to FIG. 3, the flange 346 of housing 342 is configured to rest on or physically engage axial end 30*a* of tubular member 10, and thus, biasing member 318 acts against or physically engages flange 346 of housing 342 and a flange 312*e* of swivel 312. In this way, biasing member 318 supports the weight of motor 110, cleaning fluid actuator 130, and cleaning fluid delivery system 310 against flange 346, which transfers this load to tubular member 10. Therefore, instead of protective housing 340 being moved axially relative tubular member 10 to clean the axial length of threaded coupler 32, as with the protective housings of thread cleaning assemblies 100, 200, for pin end 20, the protective housing 340 is held axially stationary with respect to tubular 10, with fluid delivery system 310 moving axially relative protective housing 310. Flange 346 includes a centrally disposed aperture 346*a* (shown in FIG. 4), allowing conduit 314 to pass therethrough such that cleaning fluid delivery system 310 may move axially with respect to protective housing 340. As fluid delivery system 310 is displaced downwards towards tubular member 10, biasing member 318 becomes compressed, as shown in FIG. 3, thus providing a resistive or biasing force against fluid delivery system 310 in the opposite or upward direction. In this embodiment, biasing member 318 is shown as a coiled spring; however, in other embodiments biasing member 318 may be other types of biasing members configured to produce a biasing force, such as elastomers and the like. Further, in other embodiments cleaning thread assembly 300 may not include a biasing member 318 altogether.

Protective housing 340 also includes three equidistant circumferentially spaced slots 350 that extend axially from flange 346 downwards towards lower end 344*b* of cylindrical body 344. Disposed adjacently below each slot 350 is a tab 352 that extends radially outward from cylindrical body 344. Each radially extending tab 352 includes a centrally disposed aperture 354 configured to receive a bolt.

Each radially extending tab 352 couples to a centralizer assembly 360. Centralizer assembly 360 generally includes an upper bracket 362, a splined member 370, a latch assembly 380, and a biasing member 400. Upper brackets 362 are configured to couple centralizer assembly 360 to housing 342 and include a pair of proximally disposed but circumferentially spaced bracket members 362*a* and 362*b*. Each bracket member 362 and 362*b* includes a support portion 364 and a radially extending portion 368. Each support portion 364 is disposed against upper flange 346 of housing 342 and includes a plurality of apertures 366 that extend therethrough. Upper flange 346 of housing 342 includes a plurality of corresponding apertures (not shown) such that bolts may be disposed in the apertures 366 of brackets 362 and the apertures of upper flange 346 to couple brackets 362 to housing 342.

Radially extending portions 368 extends axially upward and radially outward from support portions 364. A central or longitudinal axis 365 (365*a*, 365*b*, 365*c*, respectively, for each bracket 362) is formed between the radially extending portions of bracket members 362*a* and 362*b*, with the longitudinal axes 365*a*, 365*b*, and 365*c* intersecting at longitudinal axis 15 of tubular member 10. Radially extending portions 368 include a first axial end 368*a* and a second axial end 368*b*, with end 368*b* being disposed distal longitudinal axis 15 with respect to end 368*a*. Portions 368 each include an aperture 368*c* extending therethrough proximal axial end 368*b*. Also, radially extending portion 368 of bracket member 362*b* includes a tab 368*d* proximal axial end 368*a* having a groove 368*e* disposed thereon. Tab 368*d* of the radially extending portion 368 of bracket member 362*b* is configured to couple the bracket member 362*b* to the biasing member 400.

Splined member 370 is configured to physically engage the outer surface 12 of tubular member 10 so as to align the longitudinal axis 15 of tubular member 10 with axis 312*d* of output shaft 312*c*. Splined member 370 has a first or lower axial end 370*a* and a second or upper axial end 370*b*. Splined member 370 includes an aperture 372 extending therethrough proximal lower end 370*a* and configured to receive a bolt that is also received within aperture 354 of tab 352, coupling splined member 370 to housing 342. Moreover, splined member 370 is configured to rotate about the bolt disposed in aperture 372, forming a hinged connection or pivot joint 372*a* to tab 352 of housing 342. Splined member 370 also includes a plurality of splines 374 extending from upper axial end 370*b*. Splines 374 are generally configured to releasably couple or engage the latch assembly 380. Splined member 370 further includes an elongate slot 376 configured to act as a handle for convenient repositioning via rotating member 370 about the pivot joint 372*a* formed at aperture 372, as will be explained further herein.

Latch assembly 380 is configured to releasably couple with or engage splined member 370 so as to retain splined member 370 in a specific rotational position with respect to housing 342 and tubular member 10. Latch assembly 380 generally includes a latch member 382 and a retaining pin 394. Latch member 382 has a first axial end 382*a* and a second axial end 382*b* with end 382*b* disposed distal longitudinal axis 15 of tubular member 10 relative to end 382*a*. Latch member 382 includes a first aperture 384 proximal axial end 382*b* configured to receive a bolt 386 that extends through aperture 384 of latch member 382 and aperture 368*c* of bracket members 362*a* and 362*b* to pivotably couple latch member 382 to bracket 362, forming a pivot joint 388 about which latch member 382 is rotatable or pivotable. Latch member 382 also includes a spline 390 at axial end 382*a* configured to enter into interlocking, releasable engagement with the splines 374 of spline member, releasably coupling splined member 370 to latch assembly 380. Latch member 382 further includes a second aperture 392 proximal first axial end 382 configured to receive retaining pin 394. Pin 394 includes a handle or lever 396 disposed at a first end and an annular groove 398 proximal a second end.

Biasing member 400 has a first end coupled to groove 368*e* of tab 368*d* and a second end coupled to groove 398 of retaining pin 394, thereby coupling bracket member 362*b* to latch assembly 380. Biasing member 400 is configured to prevent splined member 370 from decoupling from latch assembly 380 during operation of thread cleaning device 300. In particular, biasing member 400 is configured to provide a biasing force urging spline 390 of latch member 382 into interlocking engagement with splines 374 of splined member 370.

Referring to FIGS. 5A-5D, centralizer assembly 360 is shown in various rotational positions to center protective housing 340 against tubular members 10 having varying diameters. For instance, the diameter of outer surface 12 of tubular members 10 varies in each FIG. 5A-5D, with the diameter of outer surface 12 being the largest in FIG. 5A, and the smallest in FIG. 5D. Centralizer assembly 360 may be adjusted to accommodate or fit against tubular members 10 having different diameters of outer surface 12 by adjusting the rotational position of splined member 370.

Referring to FIGS. 8A-10, an embodiment of a pin end thread cleaning machine 400 is shown. In this embodiment thread cleaning machine 400 is generally configured to receive and service the pin end 20 of tubular member 10. Thread cleaning machine 400 is also configured to be actuatable to service the pin end 20 of tubular member 10 via one or more actuators. In an embodiment, thread cleaning machine 400 is configured to be controlled by thread cleaning control system. For instance, thread cleaning machine 400 may be configured to be automatically service the pin end 20 of tubular member 10 via a thread cleaning control system.

Thread cleaning machine 400 generally includes a motor 410, a cleaning fluid inlet 430, a thread cleaning control system 430 (shown in FIG. 10), cleaning fluid delivery system 150, and upper housing 172. Motor 410 is configured to provide power to thread cleaning machine 400, and in particular, to provide torque or rotational motion to the cleaning fluid delivery system 150 such that it may rotate about pin end 20 of tubular member 10. Motor 410 generally includes an input 412 and an output 414. Input 412 receives power from a power source of thread cleaning control system 430 coupled to motor 410 and output 414 outputs rotational torque to the delivery system 150. Thus, motor 410 is configured to convert the power received at input 412 into rotational power or torque at output 414. In this embodiment, motor 410 is an air motor; however, in other embodiments motor 410 may be another type of motor configured to provide rotational torque, such as an electric motor, hydraulic motor, or other types. Motor 410 also includes a generally cylindrical support shaft 416 (shown in FIG. 9) having a first end 416*a* that couples to upper flange 174 of upper housing 172 and a second end 416*b* that couples to the body of motor 410. Support shaft 416 is configured to support the weight of motor 410 by transferring the force created by the weight of motor 410 to the upper housing 172.

Cleaning inlet 420 is configured to provide cleaning fluid delivery system 150 with a stream of pressurized cleaning fluid for cleaning the threaded coupler 22 of the pin end 20 of tubular member 10. Cleaning fluid inlet 420 generally includes an input 422 and an output 424. Input 422 receives pressurized cleaning fluid from the cleaning fluid control system coupled to inlet 420 via input 422, and output 424 provides pressurized cleaning fluid to fluid delivery system 150. In this embodiment, cleaning fluid inlet 420 provides a supply of water to fluid delivery system 150; however, in other embodiments cleaning fluid inlet 420 may provide other fluids for cleaning the thread assembly 22 of tubular member 10. In this embodiment, cleaning fluid inlet 420 provides cleaning fluid at approximately 3,000 pounds per square inch (PSI) and at a flow rate of approximately four GPM; however, in other embodiments cleaning fluid inlet 420 may provide cleaning fluid at other pressures and flow rates.

Cleaning fluid control system 430 is generally configured to control the servicing of pin end 20 of tubular member 10 by pin end thread cleaning machine 400. Cleaning fluid control system 430 generally includes a frame assembly 432 and a control assembly 450. The frame assembly 432 is configured to control the axial position of the cleaning fluid delivery system 150 and upper housing 172. The control assembly 450 is also configured to control the actuation of power provided to motor 410 and pressurized cleaning fluid delivered to cleaning fluid inlet 420.

The frame assembly 432 generally includes a frame 434, a joint support 436, an actuator 440, a guide track 442, and a housing support or member 444. The frame 434 is configured to support the weight of the pin end 20 of tubular member 10, the cleaning fluid delivery system 150, and the upper housing 172 by transferring the force created by the weight of these components to a support surface such as floor 5. Joint support 436 is coupled to frame 434 and is configured to physically engage and transfer the weight of pipe end 20 of tubular member 10 to the frame 434. Joint support 436 includes a pair of supports or saddles 438 at each axial end of joint support 436 to the outer surface 12 of tubular member 10. Guide track 442 is also coupled to frame 434 and is configured to guide the housing support 444 between an extended position (shown in FIG. 8A) and an inserted position (FIG. 8B). Actuator 440 is connected to control assembly 450 and is configured to actuate the housing support 444 between the extended and inserted positions in response to actuation from the control assembly 450. Actuator includes a first end 440*a* coupled to and stationary with the frame 434 and a second end 440*b* coupled to housing support 444 that is axially displaceable with respect to the frame 434. In this embodiment, actuator 440 is pneumatically actuated; however, in other embodiments actuator 440 may be actuated hydraulically, electrically and the like. Housing support 444 is coupled to and guided between extended and inserted positions by guide track 442 and is displaced along track 442 via actuator 440. Housing support includes a pair of flanges 446 that couple to flanges 174 and 176 of upper housing 172. Thus, upper housing 172 and cleaning fluid delivery system 150 are displaced in conjunction with housing support 444 in response to the actuation of actuator 440. It may be noted that lower housing 186 of previously-described embodiment is not needed and thus omitted in the embodiment of thread cleaning machine 400.

Cleaning fluid control system 450 generally includes a pneumatic or air circuit 452 and a cleaning fluid circuit 480. Pneumatic circuit 452 is generally configured to provide pressurized air to the motor 410, the cleaning fluid circuit 480, and the actuator 440. The cleaning fluid circuit 480 is generally configured to provide pressurized cleaning fluid to the cleaning fluid delivery system 150. Pneumatic circuit 452 includes a pressure regulator configured to regulate the pressure of pressurized air 456 received at an inlet 454*a*. Pressure regulator 454 is coupled to a first T-junction 462 via a pneumatic conduit 458. First T-junction 462 includes an inlet 462*a*, a first outlet 462*b*, and a second outlet 462*c*. A first manual valve 460 is coupled between inlet 462*a* of T-junction 462 and conduit 458 to allow the manual isolation of T-junction 462 from pressurized air 456. T-junction 462 is configured to provide pressurized air 456 to a first or actuator valve 464 via first outlet 462*b* and to a second or cleaning fluid delivery valve 472 via second outlet 462*c*.

Figure 8A:
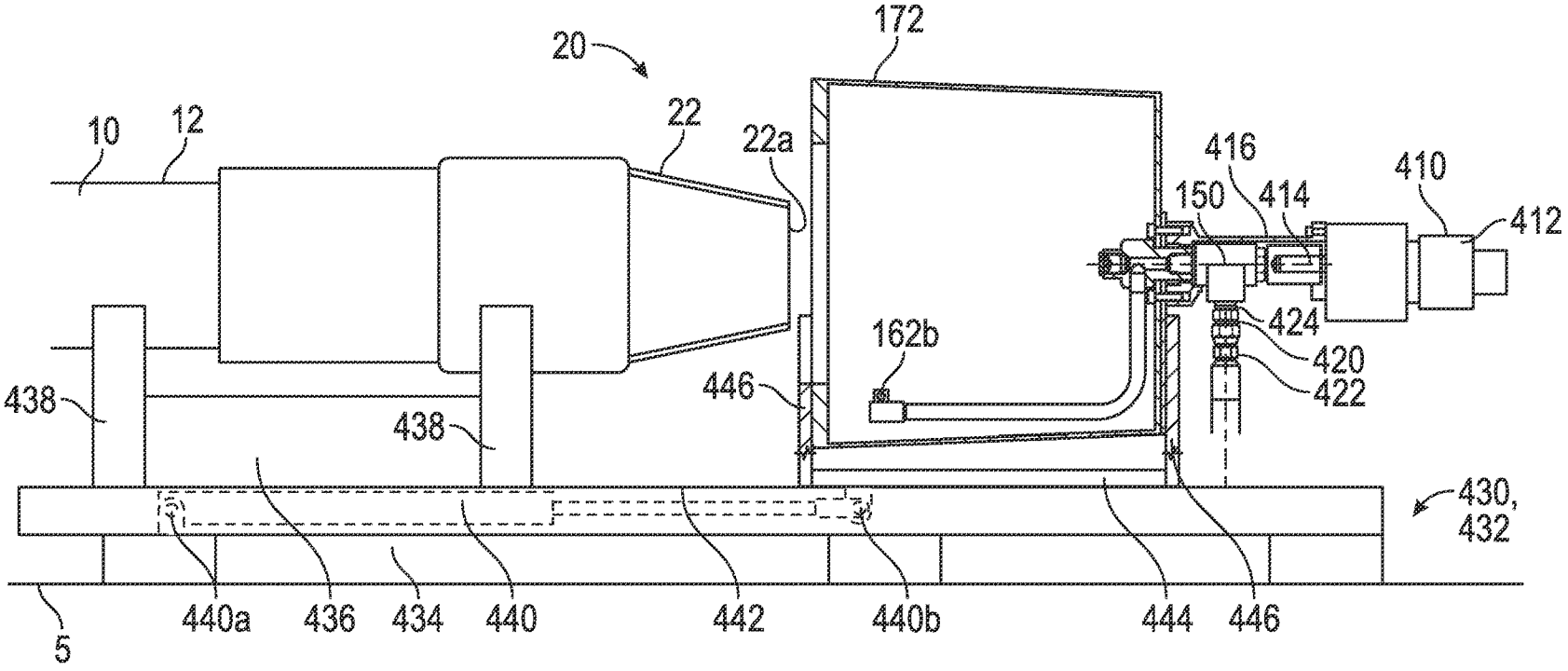
FIGS. 8A and 8B are side, partial cross-sectional views of an embodiment of a pin end thread cleaning device in accordance with principles disclosed herein.
Figure 8B:
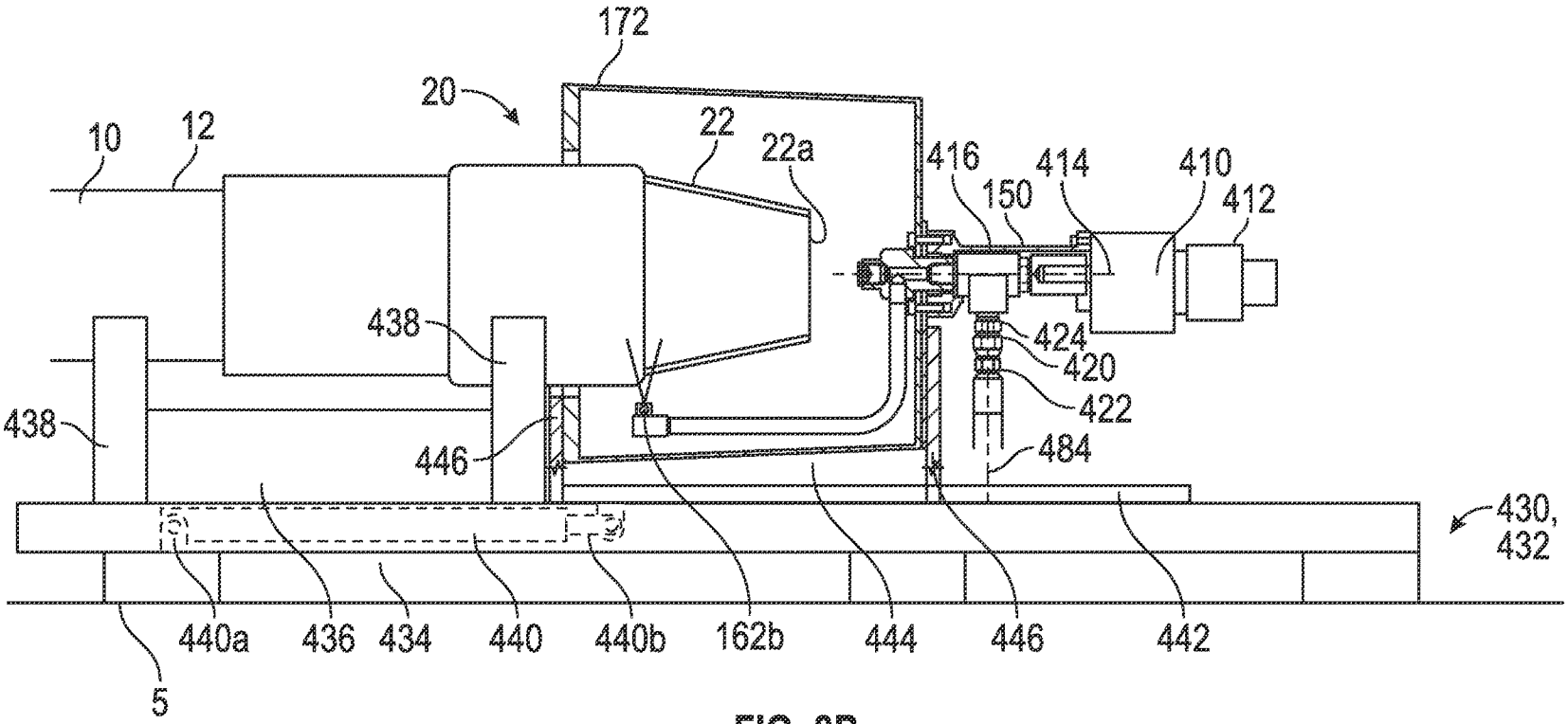

Actuator valve 464 is configured to control the actuation of actuator 440 between the extended and retracted positions shown in FIGS. 8A and 8B. Valve 464 includes a first or extending outlet 464*a* and a second or retracting outlet 464*b*. Each outlet 464*a* and 464*b* is coupled to an actuator or flow controller 466 configured for controlling the flow rate of pressurized air 456. The pneumatic conduit 468 coupled to extending outlet 464*a* is coupled to an extending inlet 470*a* of actuator 440. Similarly, the conduit 468 coupled to retracting outlet 464*b* is coupled to a retracting inlet 470*b* of actuator 440. Thus, an operator may manually adjust either of controllers 466 to adjust the rate or speed of actuation of actuator 440 between the extended and inserted positions. Further, controllers 466 may be controlled automatically using an algorithm or program executed by a computer. Actuator valve 464 also includes a selector or lever 464*c* for controlling the flow of pressurized air 456 through actuator valve 464. Lever 464*c* includes a first position where pressurized air 456 is not supplied to either of outlets 464*a* or 464*b*, an extending position where pressurized air 456 is only supplied to extending outlet 464*a*, and a retracting position where pressurized air 456 is only supplied to retracting outlet 464*b*. When lever 464*c* is in the first position, the actuator 440 is held in a stationary position. When lever 464*c* is in the extended position, the actuator 440 is extended or actuates between the inserted position shown in FIG. 8B to the extended position shown in FIG. 8A. When lever 464*c* is in the retracted position, the actuator 440 is refracted or actuates between the extended position to the inserted position. In the embodiment shown in FIG. 10, actuator valve 464 is manually actuated between its three previously-described positions via lever 464*c*; however, in other embodiments lever or selector 464*c* may be actuated automatically by an electronic solenoid controlled by an algorithm executed by a computer coupled to and in signal communication with the solenoid.

Fluid delivery valve 472 includes an inlet 472*a* that receives pressurized air 456 from outlet 462*c*, a first outlet 472*b*, a second inlet or return 472*c*, and a selector or lever 472*d*. Lever 472*d* includes a first or closed position where pressurized air 456 is not supplied to either outlet 472*b*, and a second or open position where pressurized air 456 is supplied to outlet 472*b*. In the embodiment shown in FIG. 10, cleaning fluid valve 472 is manually actuated between its two previously described positions via lever 472*d*; however, in other embodiments lever or selector 472*d* may be actuated automatically by an electronic solenoid controlled by an algorithm executed by a computer coupled to and in signal communication with the solenoid.

Outlet 472*b* couples to a second T-junction 474 having a pair of outlets 474*a* and 474*b*. Outlet 474*a* couples to a flow control motor 476 configured to regulate the flow of pressurized air 456 into a conduit 478 that connects to input 412 of motor 410. Outlet 474*b* of T-junction 474 couples to an air operated, pressurized fluid valve 482 via another pneumatic conduit 478. Return 472*c* of cleaning fluid valve 472 couples to pressurized fluid valve 482 via yet another conduit 478. Pressurized fluid valve 482 is configured to be actuated between an open position, allowing the flow of pressurized cleaning fluid 484 to pass through valve 482, and a closed position restricting the flow pressurized cleaning fluid 484 through valve 482, by the flow of pressurized air 456 from cleaning fluid valve 472 via a pair of ports 482*a*. Fluid valve 482 is configured to receive pressurized cleaning fluid 484 from a second inlet 482*b*. Outlet 482*c* is coupled with a cleaning fluid conduit 484 that is connected to the input 432 of cleaning fluid inlet 430, thus providing pressurized cleaning fluid 484 to the cleaning fluid delivery system 150. Thus, when valve 472 is actuated into the open position, pressurized air 456 is simultaneously provided to motor 410 and to valve 482, actuating valve 482 into the open position such that pressurized cleaning fluid 484 may be provided concurrently to nozzle 162*b*.

Figure 11A:
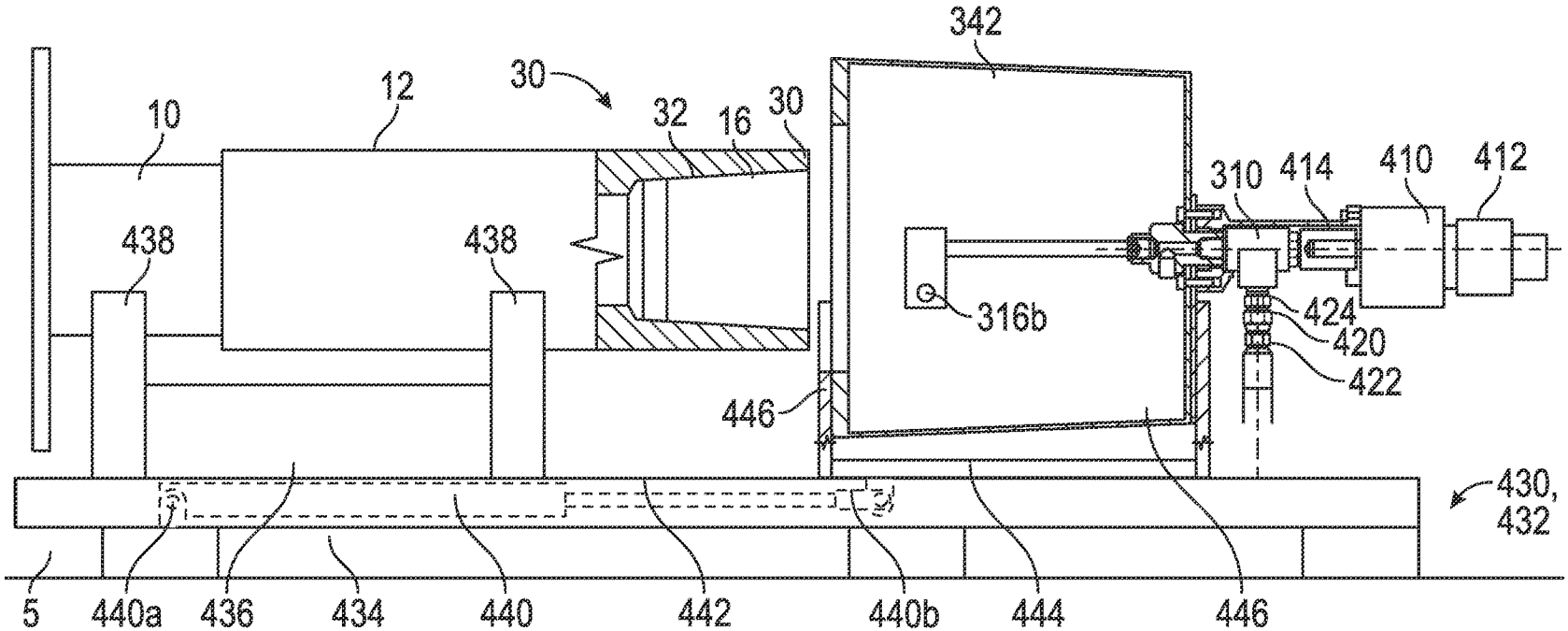
FIGS. 11A and 11B are side, partial cross-sectional view of an embodiment of a box end thread cleaning device in accordance with principles disclosed herein.
Figure 11B:
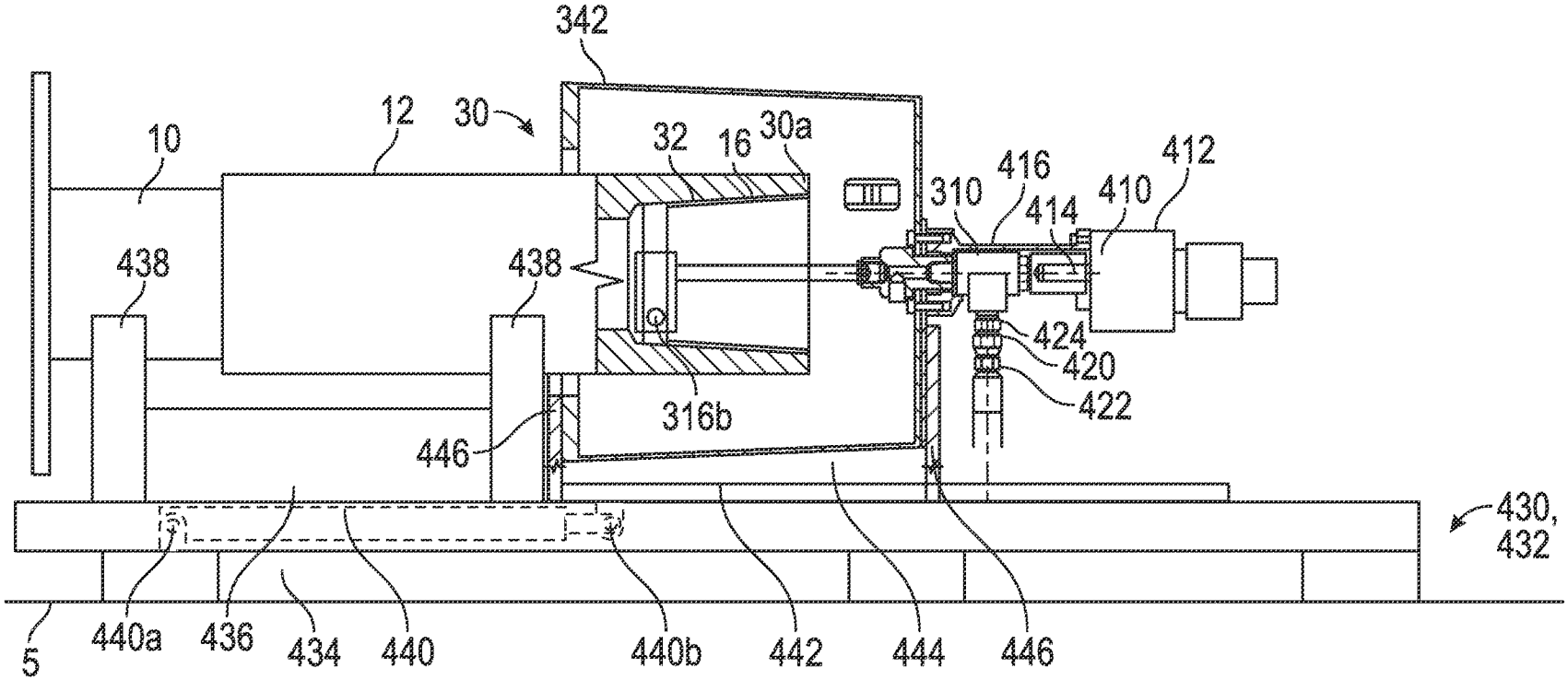

Referring now to FIGS. 11A and 11B, an embodiment of a box end thread cleaning machine 500 is shown. In this embodiment thread cleaning machine 400 is generally configured to receive and service the box end 30 of tubular member 10. Thread cleaning machine 500 is also configured to be actuatable to service the box end 30 of tubular member 10 via one or more actuators. In an embodiment, thread cleaning machine 500 is configured to be controlled by thread cleaning control system. For instance, thread cleaning machine 500 may be configured to be automatically service the box end 30 of tubular member 10 via a thread cleaning control system.

Box end thread cleaning machine 500 generally includes motor 410, cleaning fluid inlet 430, thread cleaning control system 430 (shown in FIG. 10), cleaning fluid delivery system 310, and housing 342. Box end thread cleaning machine 500 operates similarly as pin end thread cleaning machine 400. For example, upon actuation of actuator 440 via actuator valve 460, the cleaning fluid delivery system 310 and housing 342 may be displaced between an extended position shown in FIG. 11A, where the delivery system 310 and housing 342 are distal pin end 30 of tubular member 10, and an inserted position shown in FIG. 11B, where delivery system 310 is inserted into box end 30 and housing 342 is disposed about end 30. Also, actuation of cleaning fluid valve 472 causes cleaning fluid delivery system 310 to operate by supplying rotational movement to motor 410 and pressurized cleaning fluid to input 432 of cleaning fluid inlet 430.

Having described various embodiments of thread cleaning assemblies (i.e., thread cleaning assemblies 100, 200, and 300), methods of operating the embodiments of thread cleaning assemblies described above shall now be discussed. In an embodiment, a thread cleaning device, such as thread cleaning devices 100, 200, and 300, is used to service a tubular member. In particular, a thread cleaning device may be used to service a tubular member on a drilling rig or platform, a pipe inspection plant, or a machine shop, as well as other locations. Also, the tubular member may be in a horizontal or vertical position during servicing. A method of servicing or cleaning a threaded coupler 22 of a pin end 20 of a tubular member 10 using a thread cleaning device 100 may include inserting pin end 22 axially into protective housing 170 until end 20*a* of tubular member 10 enters into alignment with nozzle 162*b* of third elbow 162. Once pin end 20 has been inserted into housing 170, lever 116 of motor 110 and lever 136 of cleaning fluid actuator 130 may be actuated, causing third elbow 162 to rotate about pin end 20 and nozzle 162*b* to eject a stream of pressurized cleaning fluid. Tubular member 10 may then be slowly further inserted axially into housing 170, allowing the entire surface area of threaded coupler 22 to be contacted by the jet of pressurized cleaning fluid 164. Once this is completed, actuation of levers 116 and 136 may be ceased, and tubular member 10 may be retracted from protective housing 170. During operation of the thread cleaning device 100 to service pin end 20 of tubular member 10, the weight of thread cleaning device 100 is supported by the operator, and the motor 110 and cleaning fluid actuator 130 are actuated by hand. While in this embodiment, the method is performed using thread cleaning device, this method could also be performed similarly using thread cleaning device 200 of FIG. 2.

A method of servicing or cleaning a threaded coupler 32 of a box end 30 of a tubular member 10 using a thread cleaning device 300 may include inserting box end 32 axially into housing 342 until end 30*a* of tubular member 10 abuts or engages flange 346 of housing 342. Next, tubular member 10 may be centralized within housing 342 such that longitudinal axis 15 of member 10 is disposed coaxially with axis 352*d* of T-junction 352. A method of centralizing tubular member 10 using centralizer assembly 360 includes centralizing tubular member 10 within housing 342 by hand, and then lifting retaining pin 394 by hand to disengage the spline 390 of latch member 382 from splines 374 of splined member 370, allowing splined member to rotate about pivot joint 372*a*. Next, while the tubular member 10 is centralized within housing 342, the splined member 370 is rotated towards tubular member 10 until it engages outer surface 12 of member 10. At this point, retaining pin 394 is released, allowing spline 390 of latch member 382 to engage corresponding splines 374 of splined member 370 as latch member 382 is rotated by the biasing force provided by biasing member 400. This process is repeated for the other centralizer assemblies 360 of housing 340, thereby restricting the position of tubular member 10 into coaxial alignment with cleaning fluid delivery system 310. A this point, lever 116 of motor 110 and lever 136 of cleaning fluid actuator 130 may be actuated, causing third elbow 162 to rotate about pin end 20 and nozzle 162*b* to eject a stream of pressurized cleaning fluid. Elbow 316 of cleaning fluid delivery system 310 may then be slowly displaced into bore 14 of tubular member 10 by providing a force against fluid delivery system 310, which acts against the biasing force provided by biasing member 318, allowing the entire surface area of threaded coupler 32 of box end 32 to be contacted by the jet of pressurized cleaning fluid 164. Once this is completed, actuation of levers 116 and 136 may be ceased, and tubular member 10 may be retracted from housing 342.

A method of servicing or cleaning threaded coupler 22 of pin end 20 of tubular member 10 using thread cleaning machine 400 may include disposing the pin end 20 of tubular member 10 on saddles 438 of joint support 436. Following the placement of pin end 20, lever 472*d* of cleaning fluid valve 472 may be actuated by an operator from the closed position to an open position, causing pressurized air 456 and pressurized cleaning fluid 484 to be supplied to cleaning fluid delivery system 150, causing in turn the rotation of nozzle 162*b* and the ejection of cleaning fluid spray 164. Next, lever 464*c* of actuator valve 464 may be manually operated by an operator, switching the actuator valve from the first position to the refracted position, causing actuator 440 and cleaning fluid delivery system 150 to be displaced towards the inserted position shown in FIG. 8A. Actuator 440 may be continually retracted, allowing the cleaning fluid spray 164 to cover the entire axial length of threaded coupler 22 as cleaning fluid delivery system 150 moves axially with respect to tubular member 10.

Once cleaning fluid delivery system 150 has been fully retracted, lever 464*c* of actuator valve 464 may be actuated into the extended position, extending fluid delivery system 150 from the inserted position of FIG. 8B to the extended position of FIG. 8A. Once cleaning fluid delivery system 150 and actuator 440 have reached the extended position shown in FIG. 8A, lever 472*d* of cleaning fluid valve may be actuated by an operator into the closed position, ceasing the supply of pressurized air 456 and pressurized cleaning fluid 484 to the cleaning fluid delivery system 150. Finally, the serviced or cleaned pin end 20 of tubular member 10 may be removed from the saddles 438 of joint support 436. Although this method includes the manual operation of actuation valve 464 and cleaning fluid valve 472, in another method valves 464 and 472 may be operated automatically via an algorithm or code executed by a computer connected to the cleaning fluid control system 430. For instance, valves 464 and 472 may be coupled to electronically controlled solenoids operated by the computer algorithm. In this embodiment, an operator need only program the computer algorithm and then initiate or execute the algorithm on the computer.

A method of servicing or cleaning threaded coupler 32 of box end 30 of tubular member using thread cleaning machine 500 may include disposing the box end 30 of tubular member 10 on saddles 438 of joint support 436. Following the placement of box end 30, lever 472*d* of cleaning fluid valve 472 may be actuated by an operator from the closed position to an open position, causing pressurized air 456 and pressurized cleaning fluid 484 to be supplied to cleaning fluid delivery system 310, causing in turn the rotation of nozzle 316*b* and the ejection of cleaning fluid spray 320. Next, lever 464*c* of actuator valve 464 may be manually operated by an operator, switching the actuator valve from the first position to the retracted position, causing actuator 440 and cleaning fluid delivery system 310 to be displaced towards the inserted position shown in FIG. 8A. Actuator 440 may be continually retracted, allowing the cleaning fluid spray 164 to cover the entire axial length of threaded coupler 32 as cleaning fluid delivery system 310 moves axially with respect to tubular member 10.

Once cleaning fluid delivery system 310 has been fully retracted, lever 464*c* of actuator valve 464 may be actuated into the extended position, extending fluid delivery system 310 from the inserted position of FIG. 8B to the extended position of FIG. 8A. Once cleaning fluid delivery system 310 and actuator 440 have reached the extended position shown in FIG. 8A, lever 472*d* of cleaning fluid valve may be actuated by an operator into the closed position, ceasing the supply of pressurized air 456 and pressurized cleaning fluid 484 to the cleaning fluid delivery system 310. Finally, the serviced or cleaned box end 30 of tubular member 10 may be removed from the saddles 438 of joint support 436. As with the method of servicing pin end 20, although this method of servicing box end 30 includes the manual operation of actuation valve 464 and cleaning fluid valve 472, in another method valves 464 and 472 may be operated automatically via an algorithm or code executed by a computer connected to the cleaning fluid control system 430. For instance, valves 464 and 472 may be coupled to electronically controlled solenoids operated by the computer algorithm. In this embodiment, an operator need only program the computer algorithm and then initiate or execute the algorithm on the computer.

While the disclosure has included details of a finite number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

What is claimed is:

1. An apparatus configured for servicing threaded pipes, comprising:
   - a cleaning fluid delivery system, comprising:
     - a fluid conduit having a longitudinal axis;
     - an elbow coupled to an end of the fluid conduit, wherein the elbow comprises a longitudinal axis that is disposed at an angle relative to the longitudinal axis of the fluid conduit; and
     - a nozzle extending from the elbow, wherein the nozzle comprises a longitudinal axis that is disposed at an angle relative to both the longitudinal axis of the fluid conduit and the longitudinal axis of the elbow;
     - wherein the nozzle is configured to radially and transversely clean the threaded pipe;
   - a motor configured to provide rotational movement to the cleaning fluid delivery system; and
   - a cleaning fluid actuator configured to provide pressurized cleaning fluid to the cleaning fluid delivery system.

2. The apparatus of claim 1, wherein the cleaning fluid delivery system is configured to direct a jet of cleaning fluid at a non-perpendicular angle relative to a surface of the threaded pipe.

3. The apparatus of claim 2, wherein the cleaning fluid delivery system is configured to direct a jet of cleaning fluid at an acute angle relative to a surface of the threaded pipe.

4. The apparatus of claim 1, wherein the cleaning fluid delivery system is configured to direct a jet of cleaning fluid towards a threaded coupler of a box end of the threaded pipe.

5. The apparatus of claim 1, wherein the cleaning fluid delivery system is configured to direct a jet of cleaning fluid towards a threaded coupler of a pin end of the threaded pipe.

6. The apparatus of claim 1, wherein the cleaning fluid delivery system is configured to be operated by hand.

7. The apparatus of claim 1, wherein the cleaning fluid delivery system is configured to direct a jet of cleaning fluid towards a threaded coupler of the threaded pipe when the threaded pipe is either in a horizontal or a vertical position.

8. The apparatus of claim 1, further comprising a protective housing, comprising:

a generally cylindrical housing coupled to the cleaning fluid delivery system and disposed about an end of the threaded pipe; and a centralizer assembly coupled to the cylindrical housing and configured to coaxially align a central axis of an output shaft of the cleaning fluid delivery system and a central axis of the threaded pipe.

9. The apparatus of claim 8, wherein the centralizer assembly comprises:

a splined member pivotably coupled to an outer surface of the cylindrical housing; and a latch coupled to a flange of the cylindrical housing and configured to releasably couple with the splined member.

10. The apparatus of claim 9, wherein the splined member comprises one or more splines configured to enter into interlocking engagement with a spline of the latch.

11. An apparatus configured for servicing threaded pipes, comprising:

a cleaning fluid delivery system with a nozzle;

a motor configured to provide rotational movement to the cleaning fluid delivery system; and a cleaning fluid actuator configured to provide pressurized cleaning fluid to the cleaning fluid delivery system;

wherein the nozzle is configured to radially and transversely clean the threaded pipe;

wherein the cleaning fluid delivery system is configured to be operated by hand.

12. The apparatus of claim 11, wherein the cleaning fluid delivery system is configured to direct a jet of cleaning fluid at a non-perpendicular angle relative to a surface of the threaded pipe.

13. The apparatus of claim 12, wherein the cleaning fluid delivery system is configured to direct a jet of cleaning fluid at an acute angle relative to a surface of the threaded pipe.

14. The apparatus of claim 11, wherein the cleaning fluid delivery system is configured to direct a jet of cleaning fluid towards a threaded coupler of a box end of the threaded pipe.

15. The apparatus of claim 11, wherein the cleaning fluid delivery system is configured to direct a jet of cleaning fluid towards a threaded coupler of a pin end of the threaded pipe.

16. The apparatus of claim 11, wherein the cleaning fluid delivery system is configured to direct a jet of cleaning fluid towards a threaded coupler of the threaded pipe when the threaded pipe is either in a horizontal or a vertical position.

17. The apparatus of claim 11, further comprising a protective housing, comprising:

a generally cylindrical housing coupled to the cleaning fluid delivery system and disposed about an end of the threaded pipe; and a centralizer assembly coupled to the cylindrical housing and configured to coaxially align a central axis of an output shaft of the cleaning fluid delivery system and a central axis of the threaded pipe.

18. The apparatus of claim 17, wherein the centralizer assembly comprises:

a splined member pivotably coupled to an outer surface of the cylindrical housing; and a latch coupled to a flange of the cylindrical housing and configured to releasably couple with the splined member.

19. The apparatus of claim 18, wherein the splined member comprises one or more splines configured to enter into interlocking engagement with a spline of the latch.

20. An apparatus configured for servicing threaded pipes, comprising:

a cleaning fluid delivery system, comprising:

a fluid conduit having a longitudinal axis;

an elbow coupled to an end of the fluid conduit, wherein the elbow comprises a longitudinal axis that is disposed at an angle relative to the longitudinal axis of the fluid conduit; and a nozzle extending from the elbow, wherein the nozzle comprises a longitudinal axis that is disposed at an angle relative to both the longitudinal axis of the fluid conduit and the longitudinal axis of the elbow;

wherein the nozzle is configured to radially and transversely clean the threaded pipe;

a motor configured to provide rotational movement to the cleaning fluid delivery system;

a cleaning fluid actuator configured to provide pressurized cleaning fluid to the cleaning fluid delivery system;

a movement actuator coupled to the cleaning fluid delivery system and configured to displace the cleaning fluid delivery system between an extended position and an inserted position; and a control system configured to control the actuation of the motor, cleaning fluid actuator, and movement actuator.

21. The apparatus of 20, wherein the control system comprises:

an actuator valve coupled to the movement actuator and configured to control the actuation of the movement actuator; and a cleaning fluid valve coupled to the motor and cleaning fluid actuator and configured to control the actuation of the motor and cleaning fluid actuator.

22. The apparatus of 21, wherein the actuator valve and the cleaning fluid valve each include a valve configured to be actuated by an operator.

23. The apparatus of 21, wherein the actuator valve and the cleaning fluid valve are each configured to be actuated by a computer.

24. The apparatus of 21, wherein the cleaning fluid valve is configured to control the amount of power provided to the motor and the amount of fluid provided to the cleaning fluid delivery system.

25. The apparatus of 20, wherein a nozzle of the cleaning fluid delivery system is disposed axially adjacent to a threaded coupler of the threaded pipe when the cleaning fluid delivery system is in the inserted position.

26. The apparatus of 20, wherein the cleaning fluid delivery system is configured to direct a jet of cleaning fluid at a non-perpendicular angle relative to a surface of the threaded pipe.

27. The apparatus of claim 21, further comprising an actuator controller configured to control the rate of actuation of the movement actuator.

28. The apparatus of claim 1, wherein the longitudinal axis of the nozzle is angled towards a direction of relative rotation between the cleaning fluid delivery system and the threaded pipe when the is motor actuated to provide rotational movement of the cleaning fluid delivery system.

* * * * *